US007378203B2

(12) United States Patent
Jubran et al.

(10) Patent No.: US 7,378,203 B2
(45) Date of Patent: May 27, 2008

(54) CHARGE TRANSPORT MATERIALS HAVING AT LEAST A METALLOCENE GROUP

(75) Inventors: Nusrallah Jubran, St. Paul, MN (US); Patrick Knoll, St. Paul, MN (US); Vytautas Getautis, Kaunas (LT); Tadas Malinauskas, Kaunas (LT); Maryte Daskeviciene, Jonava (LT); Edmundas Montrimas, Vilnius (LT); Jonas Sidaravicius, Vilnius (LT)

(73) Assignee: Samsung Electronics Co., Ltd., Kyungki-Do (KR)

( * ) Notice: Subject to any disclaimer, the term of this patent is extended or adjusted under 35 U.S.C. 154(b) by 472 days.

(21) Appl. No.: 11/081,168

(22) Filed: Mar. 16, 2005

(65) Prior Publication Data

US 2006/0210897 A1 Sep. 21, 2006

(51) Int. Cl.
*G03G 5/04* (2006.01)

(52) U.S. Cl. ..... 430/58.35; 430/70; 430/75; 430/77

(58) Field of Classification Search ..... 430/58.35, 430/77, 75, 70
See application file for complete search history.

(56) References Cited

U.S. PATENT DOCUMENTS

| | | | | |
|---|---|---|---|---|
| 4,442,193 | A | 4/1984 | Chen et al. | |
| 4,468,444 | A | 8/1984 | Contois | |
| 5,232,800 | A | 8/1993 | Pavlisko et al. | |
| 6,001,522 | A | 12/1999 | Woo et al. | |
| 6,140,004 | A | 10/2000 | Mott et al. | |
| 6,180,305 | B1 | 1/2001 | Ackley et al. | |
| 6,472,514 | B2 | 10/2002 | Kuroda | |
| 6,670,085 | B2 | 12/2003 | Jubran et al. | |
| 6,689,523 | B2 | 2/2004 | Law et al. | |
| 6,696,209 | B2 | 2/2004 | Law et al. | |
| 6,749,978 | B2 | 6/2004 | Jubran et al. | |
| 6,768,010 | B1 | 7/2004 | Tokarski et al. | |
| 6,815,133 | B2 | 11/2004 | Law et al. | |
| 6,835,513 | B2 | 12/2004 | Jubran et al. | |
| 6,835,514 | B2 | 12/2004 | Jubran et al. | |
| 7,090,953 | B2 * | 8/2006 | Getautis et al. | 430/79 |
| 7,166,400 | B2 * | 1/2007 | Tokarski et al. | 430/73 |
| 7,169,520 | B2 * | 1/2007 | Jubran et al. | 430/75 |
| 2003/0194626 | A1 | 10/2003 | Zhu et al. | |

FOREIGN PATENT DOCUMENTS

| | | |
|---|---|---|
| JP | 03242652 | 10/1991 |
| JP | 09043879 | 2/1997 |
| JP | 2004106370 | 4/2004 |

OTHER PUBLICATIONS

Russian Journal of Inorganic Chemistry, Mar. 1988, pp. 5, vol. 33, No. 3, British Library Lending Division.

Muragkar et al., Synthesis and structural studies of mono(cyclopentadienyl) titanium(IV) derivatives of acetylferrocenyl thiosemicarbazones, Indian Journal of Chemistry, Oct. 1999, pp. 6, vol. 38A, No. 10.

Bosque et al., A big(cyclopalladated) tetranuclear derivative of methyl ferrocenyl ketone azine: $[\{Pd[(\eta^5\text{-}C_5H_5)Fe(\eta^5\text{-}C_5H_3)CMe{=}N]Cl(PPh_3)\}_2]$, Journal of the Chemical Society, Dalton Transactions, 1996, pp. 3195-3200.

Lopez et al., Activation of σ(C-H) bonds of $[Fe\{(\eta^5\text{-}C_5H_4)\text{-}C(Me){=}N\text{-}N{=}C(H)(C_6H_3\text{-}2,6\text{-}R)\}_2]$ (with R =Cl or H) promoted by palladium (II), Journal of Organo metallic Chemistry, 2003, pp. 34-42, Elsevier.

Metallocene Catalysis polymerization, Unbridged Unsubstituted Cyclopentadienyl Metallocenes, pp. 16, Boulder Scientific Company.

Molecular switches based for nanoelectronic applications, pp. 8, Universitat Jaume Office of Cooperation in Research and Technologic Development.

* cited by examiner

*Primary Examiner*—John L Goodrow
(74) *Attorney, Agent, or Firm*—Patterson, Thuente, Skaar & Christensen

(57) ABSTRACT

Improved charge transport material comprises the formula:

where M comprises a metallocenyl group;

Y comprises a functional group selected from the group consisting of a metallocenyl group, a hydrazone group, an azine group, a reactive ring group, an ethylenically unsaturated group, and combinations thereof;

$R_1$ and $R_2$ comprise, each independently, H, an organic group, or an organometallic group; and X is a bond, O, S, an aminylene group, a sulfonyl group, an organic linking group, or a combination thereof.

18 Claims, No Drawings

CHARGE TRANSPORT MATERIALS HAVING AT LEAST A METALLOCENE GROUP

FIELD OF THE INVENTION

This invention relates to organophotoreceptors suitable for use in electrophotography and, more specifically, to organophotoreceptors including a charge transport material having an acyl-metallocene hydrazone group or a diacyl-metallocene dihydrazone group. The charge transport material of this invention may also comprise more than one acyl-metallocene hydrazone group and/or diacyl-metallocene dihydrazone group such that it may be a bridged or polymeric (dimeric, trimeric, tetrameric, etc.) compound.

BACKGROUND OF THE INVENTION

In electrophotography, an organophotoreceptor in the form of a plate, disk, sheet, belt, drum, or the like having an electrically insulating photoconductive element on an electrically conductive substrate is imaged by first uniformly electrostatically charging the surface of the photoconductive layer, and then exposing the charged surface to a pattern of light. The light exposure selectively dissipates the charge in the illuminated areas where light strikes the surface, thereby forming a pattern of charged and uncharged areas, referred to as a latent image. A liquid or solid toner is then provided in the vicinity of the latent image and toner droplets or particles deposit in the vicinity of either the charged or uncharged areas to create a toned image on the surface of the photoconductive layer. The resulting toned image can be transferred to a suitable ultimate or intermediate receiving surface, such as paper, or the photoconductive layer can operate as an ultimate receptor for the image. The imaging process can be repeated many times to complete a single image, for example, by overlaying images of distinct color components or effect shadow images, such as overlaying images of distinct colors to form a full color final image, and/or to reproduce additional images.

Both single layer and multilayer photoconductive elements have been used. In single layer embodiments, a charge transport material and charge generating material are combined with a polymeric binder and then deposited on the electrically conductive substrate. In multilayer embodiments, the charge transport material and charge generating material are present in the element in separate layers, each of which can optionally be combined with a polymeric binder, deposited on the electrically conductive substrate. Two arrangements are possible for a two-layer photoconductive element. In one two-layer arrangement (the "dual layer" arrangement), the charge-generating layer is deposited on the electrically conductive substrate and the charge transport layer is deposited on top of the charge generating layer. In an alternate two-layer arrangement (the "inverted dual layer" arrangement), the order of the charge transport layer and charge generating layer is reversed.

In both the single and multilayer photoconductive elements, the purpose of the charge generating material is to generate charge carriers (i.e., holes and/or electrons) upon exposure to light. The purpose of the charge transport material is to accept at least one type of these charge carriers and transport them through the charge transport layer in order to facilitate discharge of a surface charge on the photoconductive element. The charge transport material can be a charge transport compound, an electron transport compound, or a combination of both. When a charge transport compound is used, the charge transport compound accepts the hole carriers and transports them through the layer with the charge transport compound. When an electron transport compound is used, the electron transport compound accepts the electron carriers and transports them through the layer with the electron transport compound.

SUMMARY OF THE INVENTION

This invention provides organophotoreceptors having good electrostatic properties such as high $V_{acc}$ and low $V_{dis}$.

In a first aspect, this invention features a charge transport material having the formula:

(I)

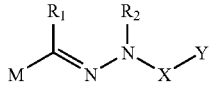

where M comprises a metallocenyl group, such as a ferrocenyl group, a nickelocenyl group, a cobaltocenyl group, a zirconocenyl group, a ruthenocenyl group, a chromocenyl group, a hafnocenyl group, a titanocenyl group, a molybdenocenyl group, a niobocenyl group, a tungstenocenyl group, and a vanadocenyl group;

Y comprises a functional group selected from the group consisting of a metallocenyl group, a hydrazone group, an azine group, a reactive ring group, such as an epoxy group, a thiiranyl group, an aziridinyl group, and an oxetanyl group, an ethylenically unsaturated group, such as a vinyl ether group, an alkenyl group, an acryloyl group, a methacryloyl group, an acrylamido group, and a methacrylamido group, and combinations thereof;

$R_1$ and $R_2$ comprise, each independently, H, an organic group, such as an alkyl group, an alkenyl group, an alkynyl group, an aromatic group, a heterocyclic group, and a part of a ring group, such as cycloalkyl groups, heterocyclic groups, and a benzo group, or an organometallic group, such as a metallocenyl group; and X comprises a bond or a linking group such as O, S, an aminylene group, a sulfonyl group, an organic linking group, and combinations thereof.

In a second aspect, the invention features a charge transport material comprising the formula:

(XIV)

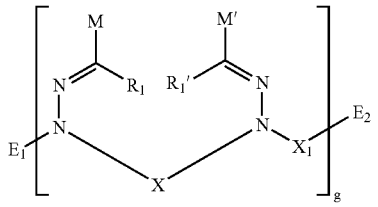

where M and M' comprise, each independently, a metallocenyl group; X and $X_1$ are, each independently, a linking group such as O, S, an aminylene group, a sulfonyl group, an organic linking group, and combinations thereof; $R_1$ and $R_1$' comprise, each independently, H, an organic group, or an organometallic group; g is an average of a distribution of integers between 1 and 5,000; and $E_1$ and $E_2$ are each a terminal group. The terminal groups may vary between different polymer units depending on the state of the particular polymerization process at the end of the polymerization step.

In a third aspect, the invention features a charge transport material comprising the formula:

(XV)

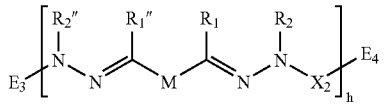

where $R_1$, $R_2$, $R_1''$, and $R_2''$ comprise, each independently, H, an organic group, or an organometallic group; $X_2$ is a linking group such as O, S, an aminylene group, a sulfonyl group, an organic linking group, and combinations thereof; M comprises a metallocenyl group; h is an average of a distribution of integers between 1 and 5,000; and $E_3$ and $E_4$ are each a terminal group. The terminal groups may vary between different polymer units depending on the state of the particular polymerization process at the end of the polymerization step.

In general, the distribution of g and h values depends on the polymerization conditions. The presence of the polymer of Formula (XIV) or (XV) does not preclude the presence of unreacted monomer within the organophotoreceptor, although the concentrations of monomer would generally be small if not extremely small or undetectable. The extent of polymerization, as specified with g or h, can affect the properties of the resulting polymer. In some embodiments, an average g or h value can be in the hundreds or thousands, although the average g or h may be any value greater than 1 and in some embodiments any value greater than 5. A person of ordinary skill in the art will recognize that additional ranges of average g or h values are contemplated and are within the present disclosure.

In some embodiments of interest, the invention features an organophotoreceptor comprises an electrically conductive substrate and a photoconductive element on the electrically conductive substrate, the photoconductive element comprising:

(a) at least one of the above-described charge transport material; and (b) a charge generating compound.

The organophotoreceptor may be provided, for example, in the form of a plate, a flexible belt, a flexible disk, a sheet, a rigid drum, or a sheet around a rigid or compliant drum. In one embodiment, the organophotoreceptor includes: (a) a photoconductive element comprising the charge transport material, the charge generating compound, a second charge transport material, and a polymeric binder; and (b) the electrically conductive substrate.

In other embodiments of interest, the invention features an electrophotographic imaging apparatus that comprises (a) a light imaging component; and (b) the above-described organophotoreceptor oriented to receive light from the light imaging component. The apparatus can further comprise a toner dispenser, such as a liquid toner dispenser. The method of electrophotographic imaging with photoreceptors containing the above noted charge transport materials is also described.

In further embodiments of interest, the invention features an electrophotographic imaging process that includes (a) applying an electrical charge to a surface of the above-described organophotoreceptor; (b) imagewise exposing the surface of the organophotoreceptor to radiation to dissipate charge in selected areas and thereby form a pattern of at least relatively charged and uncharged areas on the surface; (c) contacting the surface with a toner, such as a liquid toner that includes a dispersion of colorant particles in an organic liquid, to create a toned image; and (d) transferring the toned image to a substrate.

The invention provides suitable charge transport materials for organophotoreceptors featuring a combination of good mechanical and electrostatic properties. These photoreceptors can be used successfully with toners, such as liquid toners and dry toners, to produce high quality images. The high quality of the imaging system can be maintained after repeated cycling.

Other features and advantages of the invention will be apparent from the following description of the particular embodiments thereof, and from the claims.

DETAILED DESCRIPTION OF PREFERRED EMBODIMENTS

An organophotoreceptor as described herein has an electrically conductive substrate and a photoconductive element including a charge generating compound and a charge transport material having a charge transport material having an acyl-metallocene hydrazone group or a diacyl-metallocene dihydrazone group. The charge transport material of this invention may also comprise more than one acyl-metallocene hydrazone group and/or diacyl-metallocene dihydrazone group such that it may be a bridged or polymeric (dimeric, trimeric, tetrameric, etc.) compound. The bridged charge transport material may comprise two acyl-metallocene hydrazone groups and/or diacyl-metallocene dihydrazone groups linked together by an organic linking group. These charge transport materials have desirable properties as evidenced by their performance in organophotoreceptors for electrophotography. In particular, the charge transport materials of this invention have high charge carrier mobilities and good compatibility with various binder materials, and possess excellent electrophotographic properties. The organophotoreceptors according to this invention generally have a high photosensitivity, a low residual potential, and a high stability with respect to cycle testing, crystallization, and organophotoreceptor bending and stretching. The organophotoreceptors are particularly useful in laser printers and the like as well as fax machines, photocopiers, scanners and other electronic devices based on electrophotography. The use of these charge transport materials is described in more detail below in the context of laser printer use, although their application in other devices operating by electrophotography can be generalized from the discussion below.

To produce high quality images, particularly after multiple cycles, it is desirable for the charge transport materials to form a homogeneous solution with the polymeric binder and remain approximately homogeneously distributed through the organophotoreceptor material during the cycling of the material. In addition, it is desirable to increase the amount of charge that the charge transport material can accept (indicated by a parameter known as the acceptance voltage or "$V_{acc}$"), and to reduce retention of that charge upon discharge (indicated by a parameter known as the discharge voltage or "$V_{dis}$").

Charge transport materials may comprise monomeric molecules (e.g., N-ethyl-carbazolo-3-aldehyde N-methyl-N-phenyl-hydrazone), dimeric molecules (e.g., disclosed in U.S. Pat. Nos. 6,140,004, 6,670,085 and 6,749,978), or polymeric compositions (e.g., poly(vinylcarbazole)). The charge transport materials can be classified as a charge transport compound or an electron transport compound. There are many charge transport compounds and electron transport compounds known in the art for electrophotography. Non-limiting examples of charge transport compounds include, for example, pyrazoline derivatives, fluorene derivatives, oxadiazole derivatives, stilbene derivatives, enamine derivatives, enamine stilbene derivatives, hydrazone derivatives, carbazole hydrazone derivatives, (N,N-disubstituted)arylamines such as triaryl amines, polyvinyl carbazole, polyvinyl pyrene, polyacenaphthylene, and the charge transport compounds described in U.S. Pat. Nos. 6,670,085, 6,689,523, 6,696,209, 6,749,978, 6,768,010, 6,815,133, 6,835,513, and 6,835,514, and U.S. patent application Ser. Nos. 10/431,135, 10/431,138, 10/699,364, 10/663,278, 10/699,581, 10/748,496, 10/789,094, 10/644,547, 10/749,174, 10/749,171, 10/749,418, 10/699,039, 10/695,581, 10/692,389, 10/634,164, 10/749,164, 10/772,068, 10/749,178, 10/758,869, 10/695,044, 10/772,069, 10/789,184, 10/789,077, 10/775,429, 10/670,483, 10/671,255, 10/663,971, 10/760,039, 10/815,243, 10/832,596, 10/836,667, 10/814,938, 10/834,656, 10/815,118, 10/857,267, 10/865,662, 10/864,980, 10/865,427, 10/883,453, 10/929,914, and 10/900,785. All the above patents and patent applications are incorporated herein by reference.

Non-limiting examples of electron transport compounds include, for example, bromoaniline, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno[1,2-b]thiophene-4-one, and 1,3,7-trinitrodibenzothiophene-5,5-dioxide, (2,3-diphenyl-1-indenylidene)malononitrile, 4H-thiopyran-1,1-dioxide and its derivatives such as 4-dicyanomethylene-2,6-diphenyl-4H-thiopyran-1,1-dioxide, 4-dicyanomethylene-2,6-di-m-tolyl-4H-thiopyran-1,1-dioxide, and unsymmetrically substituted 2,6-diaryl-4H-thiopyran-1,1-dioxide such as 4H-1,1-dioxo-2-(p-isopropylphenyl)-6-phenyl-4-(dicyanomethylidene)thiopyran and 4H-1,1-dioxo-2-(p-isopropylphenyl)-6-(2-thienyl)-4-(dicyanomethylidene) thiopyran, derivatives of phospha-2,5-cyclohexadiene, alkoxycarbonyl-9-fluorenylidene)malononitrile derivatives such as (4-n-butoxycarbonyl-9-fluorenylidene)malononitrile, (4-phenethoxycarbonyl-9-fluorenylidene)malononitrile, (4-carbitoxy-9-fluorenylidene)malononitrile, and diethyl(4-n-butoxycarbonyl-2,7-dinitro-9-fluorenylidene) malonate, anthraquinodimethane derivatives such as 11,11,12,12-tetracyano-2-alkylanthraquinodimethane and 11,11-dicyano-12,12-bis(ethoxycarbonyl)anthraquinodimethane, anthrone derivatives such as 1-chloro-10-[bis(ethoxycarbonyl)methylene]anthrone, 1,8-dichloro-10-[bis(ethoxy carbonyl)methylene]anthrone, 1,8-dihydroxy-10-[bis(ethoxycarbonyl)methylene]anthrone, and 1-cyano-10-[bis (ethoxycarbonyl)methylene)anthrone, 7-nitro-2-aza-9-fluroenylidene-malononitrile, diphenoquinone derivatives, benzoquinone derivatives, naphtoquinone derivatives, quinine derivatives, tetracyanoethylenecyanoethylene, 2,4,8-trinitro thioxantone, dinitrobenzene derivatives, dinitroanthracene derivatives, dinitroacridine derivatives, nitroanthraquinone derivatives, dinitroanthraquinone derivatives, succinic anhydride, maleic anhydride, dibromo maleic anhydride, pyrene derivatives, carbazole derivatives, hydrazone derivatives, N,N-dialkylaniline derivatives, diphenylamine derivatives, triphenylamine derivatives, triphenylmethane derivatives, tetracyano quinodimethane, 2,4,5,7-tetranitro-9-fluorenone, 2,4,7-trinitro-9-dicyanomethylene fluorenone, 2,4,5,7-tetranitroxanthone derivatives, 2,4,8-trinitrothioxanthone derivatives, 1,4,5,8-naphthalene bis-dicarboximide derivatives as described in U.S. Pat. Nos. 5,232,800, 4,468,444, and 4,442,193 and phenylazoquinolide derivatives as described in U.S. Pat. No. 6,472,514. In some embodiments of interest, the electron transport compound comprises an (alkoxycarbonyl-9-fluorenylidene)malononitrile derivative, such as (4-n-butoxycarbonyl-9-fluorenylidene)malononitrile, and 1,4,5,8-naphthalene bis-dicarboximide derivatives.

Although there are many charge transport materials available, there is a need for other charge transport materials to meet the various requirements of particular electrophotography applications.

In electrophotography applications, a charge-generating compound within an organophotoreceptor absorbs light to form electron-hole pairs. These electrons and holes can be transported over an appropriate time frame under a large electric field to discharge locally a surface charge that is generating the field. The discharge of the field at a particular location results in a surface charge pattern that essentially matches the pattern drawn with the light. This charge pattern then can be used to guide toner deposition. The charge transport materials described herein are especially effective at transporting charge, and in particular holes from the electron-hole pairs formed by the charge generating compound. In some embodiments, a specific electron transport compound or charge transport compound can also be used along with the charge transport material of this invention.

The layer or layers of materials containing the charge generating compound and the charge transport materials are within an organophotoreceptor. To print a two dimensional image using the organophotoreceptor, the organophotoreceptor has a two dimensional surface for forming at least a portion of the image. The imaging process then continues by cycling the organophotoreceptor to complete the formation of the entire image and/or for the processing of subsequent images.

The organophotoreceptor may be provided in the form of a plate, a flexible belt, a disk, a rigid drum, a sheet around a rigid or compliant drum, or the like. The charge transport material can be in the same layer as the charge generating compound and/or in a different layer from the charge generating compound. Additional layers can be used also, as described further below.

In some embodiments, the organophotoreceptor material comprises, for example: (a) a charge transport layer comprising the charge transport material and a polymeric binder; (b) a charge generating layer comprising the charge generating compound and a polymeric binder; and (c) the electrically conductive substrate. The charge transport layer may be intermediate between the charge generating layer and the electrically conductive substrate. Alternatively, the charge generating layer may be intermediate between the charge transport layer and the electrically conductive substrate. In further embodiments, the organophotoreceptor material has a single layer with both a charge transport material and a charge generating compound within a polymeric binder.

The organophotoreceptors can be incorporated into an electrophotographic imaging apparatus, such as laser printers. In these devices, an image is formed from physical embodiments and converted to a light image that is scanned onto the organophotoreceptor to form a surface latent image. The surface latent image can be used to attract toner onto the surface of the organophotoreceptor, in which the toner image is the same or the negative of the light image projected onto the organophotoreceptor. The toner can be a liquid toner or a dry toner. The toner is subsequently transferred, from the surface of the organophotoreceptor, to a receiving surface, such as a sheet of paper. After the transfer of the toner, the surface is discharged, and the material is ready to cycle again. The imaging apparatus can further comprise, for example, a plurality of support rollers for transporting a paper receiving medium and/or for movement of the photoreceptor, a light imaging component with suitable optics to form the light image, a light source, such as a laser, a toner source and delivery system and an appropriate control system.

An electrophotographic imaging process generally can comprise (a) applying an electrical charge to a surface of the above-described organophotoreceptor; (b) imagewise exposing the surface of the organophotoreceptor to radiation to dissipate charge in selected areas and thereby form a pattern of charged and uncharged areas on the surface; (c) exposing the surface with a toner, such as a liquid toner that includes a dispersion of colorant particles in an organic liquid to create a toner image, to attract toner to the charged or discharged regions of the organophotoreceptor; and (d) transferring the toner image to a substrate.

As described herein, an organophotoreceptor comprises a charge transport material having the formula:

(I)

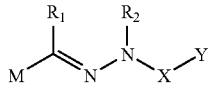

where M comprises a metallocenyl group, such as a ferrocenyl group, a nickelocenyl group, a cobaltocenyl group, a zirconocenyl group, a ruthenocenyl group, a chromocenyl group, a hafnocenyl group, a titanocenyl group, a molybdenocenyl group, a niobocenyl group, a tungstenocenyl group, and a vanadocenyl group;

Y comprises a functional group selected from the group consisting of a metallocenyl group, a hydrazone group, an azine group, a reactive ring group, such as an epoxy group, a thiiranyl group, an aziridinyl group, and an oxetanyl group, an ethylenically unsaturated group, such as a vinyl ether group, an alkenyl group, an acryloyl group, a methacryloyl group, an acrylamido group, and a methacrylamido group, and combinations thereof;

$R_1$ and $R_2$ comprise, each independently, H or an organic group, such as an alkyl group, an alkenyl group, an alkynyl group, an aromatic group, a heterocyclic group, and a part of a ring group, such as cycloalkyl groups, heterocyclic groups, and a benzo group, or an organometallic group such as a metallocenyl group; and X comprises a bond or a linking group such as O, S, an aminylene group (e.g., an NR group where R is H, an alkyl group, an alkenyl group, an alkynyl group, a carboxyl group, an acyl group, an aromatic group, or a heterocyclic group), a sulfonyl group, an organic linking group, and combinations thereof.

A heterocyclic group includes any monocyclic or polycyclic (e.g., bicyclic, tricyclic, etc.) ring compound having at least a heteroatom (e.g., O, S, N, P, B, Si, etc.) in the ring. Furthermore, the heterocyclic group may be aromatic or non-aromatic.

An aromatic group can be any conjugated ring system containing 4n+2 pi-electrons. There are many criteria available for determining aromaticity. A widely employed criterion for the quantitative assessment of aromaticity is the resonance energy. Specifically, an aromatic group has a resonance energy. In some embodiments, the resonance energy of the aromatic group is at least 10 KJ/mol. In further embodiments, the resonance energy of the aromatic group is greater than 0.1 KJ/mol. Aromatic groups may be classified as an aromatic heterocyclic group which contains at least a heteroatom in the 4n+2 pi-electron ring, or as an aryl group which does not contain a heteroatom in the 4n+2 pi-electron ring. The aromatic group may comprise a combination of aromatic heterocyclic group and aryl group. Nonetheless, either the aromatic heterocyclic or the aryl group may have at least one heteroatom in a substituent attached to the 4n+2 pi-electron ring. Furthermore, either the aromatic heterocyclic or the aryl group may comprise a monocyclic or polycyclic (such as bicyclic, tricyclic, etc.) ring.

Non-limiting examples of the aromatic heterocyclic group are furyl, thienyl, pyrrolyl, indolyl, indolizinyl, isoindolyl, pyrazolyl, imidazolyl, 1,2,4-triazolyl, 1,2,3-triazolyl, indazolyl, benzotriazolyl, benzimidazolyl, indazolyl carbazolyl, carbolinyl, benzofuranyl, isobenzofuranyl benzothiophenyl, dibenzofuranyl, dibenzothiophenyl, isothiazolyl, isoxazolyl, pyridyl, purinyl, pyridazinyl, pyrimidinyl, pyrazinyl, triazinyl, tetrazinyl, petazinyl, quinolinyl, isoquinolinyl, perimidinyl, cinnolinyl, phthalazinyl, quinazolinyl, quinoxalinyl, naphthyridinyl, acridinyl, phenanthridinyl, phenanthrolinyl, anthyridinyl, purinyl, pteridinyl, alloxazinyl, phenazinyl, phenothiazinyl, phenoxazinyl, phenoxathiinyl, dibenzo(1,4) dioxinyl, thianthrenyl, and a combination thereof. The aromatic heterocyclic group may also include any combination of the above aromatic heterocyclic groups bonded together either by a bond (as in bicarbazolyl) or by a linking group (as in 1,6 di(10H-10-phenothiazinyl)hexane). The linking group may include an aliphatic group, an aromatic group, a heterocyclic group, or a combination thereof. Furthermore, the linking group may comprise at least one heteroatom such as O, S, Si, and N.

Non-limiting examples of the aryl group are phenyl, naphthyl, benzyl, or tolanyl group, sexiphenylene, phenanthrenyl, anthracenyl, coronenyl, and tolanylphenyl. The aryl group may also include any combination of the above aryl groups bonded together either by a bond (as in biphenyl group) or by a linking group (as in stilbenyl, diphenyl sulfone, an arylamine group). The linking group may include an aliphatic group, an aromatic group, a heterocyclic group, or a combination thereof. Furthermore, the linking group may comprise at least one heteroatom such as O, S, Si, and N.

Substitution is liberally allowed on the chemical groups to affect various physical effects on the properties of the compounds, such as mobility, sensitivity, solubility, stability, and the like, as is known generally in the art. In the description of chemical substituents, there are certain practices common to the art that are reflected in the use of language. The term group indicates that the generically recited chemical entity (e.g., alkyl group, alkenyl group, alkynyl group, phenyl group, aromatic group, heterocyclic group, acyl group, amino group, oxiranyl group, oxetanyl group, thiiranyl group, aziridinyl group, acrylate group, methacrylate group, metallocenyl group, ferrocenyl group, nickelocenyl group, cobaltocenyl group, zirconocenyl group, ruthenocenyl group, chromocenyl group, hafnocenyl group, titanocenyl group, molybdenocenyl group, niobocenyl group, tungstenocenyl group, and vanadocenyl group, etc.) may have any substituent thereon which is consistent with the bond structure of that group. For example, where the term 'alkyl group' or 'alkenyl group' is used, that term would not only include unsubstituted linear, branched and cyclic alkyl group or alkenyl group, such as methyl, ethyl, ethenyl or vinyl, isopropyl, tert-butyl, cyclohexyl, cyclohexenyl, dodecyl and the like, but also substituents having heteroatom(s), such as 3-ethoxy]propyl, 4-(N,N-diethylamino)butyl, 3-hydroxypentyl, 2-thiolhexyl, 1,2,3-tribromoopropyl, and the like, and aromatic group, such as phenyl, naphthyl, carbazolyl, pyrrole, and the like. However, as is consistent with such nomenclature, no substitution would be included within the term that would alter the fundamental bond structure of the underlying group. For example, where a phenyl group is recited, substitution such as 2- or 4-aminophenyl, 2- or 4-(N,N-disubstituted)aminophenyl, 2,4-dihydroxyphenyl, 2,4,6-trithiophenyl, 2,4,6-trimethoxyphenyl and the like would be acceptable within the terminology, while substitution of 1,1,2,2,3,3-hexamethylphenyl would not be acceptable as that substitution would require the ring bond structure of the phenyl group to be altered to a non-aromatic form. Where the term moiety is used, such as alkyl moiety or phenyl moiety, that terminology indicates that the chemical material is not substituted. Where the term alkyl moiety is used, that term represents only an unsubstituted alkyl hydrocarbon group, whether branched, straight chain, or cyclic.

Organophotoreceptors

The organophotoreceptor may be, for example, in the form of a plate, a sheet, a flexible belt, a disk, a rigid drum, or a sheet around a rigid or compliant drum, with flexible belts and rigid drums generally being used in commercial embodiments. The organophotoreceptor may comprise, for example, an electrically conductive substrate and on the electrically conductive substrate a photoconductive element in the form of one or more layers. The photoconductive element can comprise both a charge transport material and a charge generating compound in a polymeric binder, which may or may not be in the same layer, as well as a second charge transport material such as a charge transport compound or an electron transport compound in some embodiments. For example, the charge transport material and the charge generating compound can be in a single layer. In other embodiments, however, the photoconductive element comprises a bilayer construction featuring a charge generating layer and a separate charge transport layer. The charge generating layer may be located intermediate between the electrically conductive substrate and the charge transport layer. Alternatively, the photoconductive element may have a structure in which the charge transport layer is intermediate between the electrically conductive substrate and the charge generating layer.

The electrically conductive substrate may be flexible, for example in the form of a flexible web or a belt, or inflexible, for example in the form of a drum. A drum can have a hollow cylindrical structure that provides for attachment of the drum to a drive that rotates the drum during the imaging process. Typically, a flexible electrically conductive substrate comprises an electrically insulating substrate and a thin layer of electrically conductive material onto which the photoconductive material is applied.

The electrically insulating substrate may be paper or a film forming polymer such as polyester [e.g., poly(ethylene terephthalate) or poly(ethylene naphthalate)], polyimide, olysulfone, polypropylene, nylon, polyester, polycarbonate, polyvinyl resin, poly(vinyl fluoride), polystyrene and the like. Specific examples of polymers for supporting substrates included, for example, polyethersulfone (STABAR™ S-100, available from ICI), poly(vinyl fluoride) (TEDLAR®, available from E.I. DuPont de Nemours & Company), polybisphenol-A polycarbonate (MAKROFOL™, available from Mobay Chemical Company) and amorphous poly(ethylene terephthalate) (MELINAR™, available from ICI Americas, Inc.). The electrically conductive materials may be graphite, dispersed carbon black, iodine, conductive polymers such as polypyrroles and CALGON® conductive polymer 261 (commercially available from Calgon Corporation, Inc., Pittsburgh, Pa.), metals such as aluminum, titanium, chromium, brass, gold, copper, palladium, nickel, or stainless steel, or metal oxide such as tin oxide or indium oxide. In embodiments of particular interest, the electrically conductive material is aluminum. Generally, the photoconductor substrate has a thickness adequate to provide the required mechanical stability. For example, flexible web substrates generally have a thickness from about 0.01 to about 1 mm, while drum substrates generally have a thickness from about 0.5 mm to about 2 mm.

The charge generating compound is a material that is capable of absorbing light to generate charge carriers (such as a dye or pigment). Non-limiting examples of suitable charge generating compounds include, for example, metal-free phthalocyanines (e.g., ELA 8034 metal-free phthalocyanine available from H.W. Sands, Inc. or Sanyo Color Works, Ltd., CGM-X01), metal phthalocyanines such as titanium phthalocyanine, copper phthalocyanine, oxytitanium phthalocyanine (also referred to as titanyl oxyphthalocyanine, and including any crystalline phase or mixtures of crystalline phases that can act as a charge generating compound), hydroxygallium phthalocyanine, squarylium dyes and pigments, hydroxy-substituted squarylium pigments, perylimides, polynuclear quinones available from Allied Chemical Corporation under the trade name INDOFAST™ Double Scarlet, INDOFAST™ Violet Lake B, INDOFAST™ Brilliant Scarlet and INDOFAST™ Orange, quinacridones available from DuPont under the trade name MONASTRAL™ Red, MONASTRAL™ Violet and MONASTRAL™ Red Y, naphthalene 1,4,5,8-tetracarboxylic acid derived pigments including the perinones, tetrabenzoporphyrins and tetranaphthaloporphyrins, indigo- and thioindigo dyes, benzothioxanthene-derivatives, perylene 3,4,9,10-tetracarboxylic acid derived pigments, polyazo-pigments including bisazo-, trisazo- and tetrakisazo-pigments, polymethine dyes, dyes containing quinazoline groups, tertiary amines, amorphous selenium, selenium alloys such as selenium-tellurium, selenium-tellurium-arsenic and selenium-arsenic, cadmium sulphoselenide, cadmium selenide, cadmium sulphide, and mixtures thereof. For some embodiments, the charge generating compound comprises oxytitanium phthalocyanine (e.g., any phase thereof), hydroxygallium phthalocyanine or a combination thereof.

The photoconductive layer of this invention may optionally contain a second charge transport material which may be a charge transport compound, an electron transport compound, or a combination of both. Generally, any charge transport compound or electron transport compound known in the art can be used as the second charge transport material.

An electron transport compound and a UV light stabilizer can have a synergistic relationship for providing desired electron flow within the photoconductor. The presence of the UV light stabilizers alters the electron transport properties of the electron transport compounds to improve the electron transporting properties of the composite. UV light stabilizers can be ultraviolet light absorbers or ultraviolet light inhibitors that trap free radicals.

UV light absorbers can absorb ultraviolet radiation and dissipate it as heat. UV light inhibitors are thought to trap free radicals generated by the ultraviolet light and after trapping of the free radicals, subsequently to regenerate active stabilizer moieties with energy dissipation. In view of the synergistic relationship of the UV stabilizers with electron transport compounds, the particular advantages of the UV stabilizers may not be their UV stabilizing abilities, although the UV stabilizing ability may be further advantageous in reducing degradation of the organophotoreceptor over time. The improved synergistic performance of organophotoreceptors with layers comprising both an electron transport compound and a UV stabilizer are described further in copending U.S. patent application Ser. No. 10/425,333 filed on Apr. 28, 2003 to Zhu, entitled "Organophotoreceptor With A Light Stabilizer," incorporated herein by reference.

Non-limiting examples of suitable light stabilizer include, for example, hindered trialkylamines such as TINUVIN™ 144 and TINUVIN™ 292 (from Ciba Specialty Chemicals, Terrytown, N.Y.), hindered alkoxydialkylamines such as TINUVIN™ 123 (from Ciba Specialty Chemicals), benzotriazoles such as TINUVAN™ 328, TINUVIN™ 900 and TINUVIN™ 928 (from Ciba Specialty Chemicals), benzophenones such as SANDUVOR™ 3041 (from Clariant Corp., Charlotte, N.C.), nickel compounds such as ARBESTAB™ (from Robinson Brothers Ltd, West Midlands, Great Britain), salicylates, cyanocinnamates, benzylidene malonates, benzoates, oxanilides such as SANDUVOR™ VSU (from Clariant Corp., Charlotte, N.C.), triazines such as CYAGARD™ UV-1164 (from Cytec Industries Inc., N.J.), polymeric sterically hindered amines such as LUCHEM™ (from Atochem North America, Buffalo, N.Y.). In some embodiments, the light stabilizer is selected from the group consisting of hindered trialkylamines having the following formula:

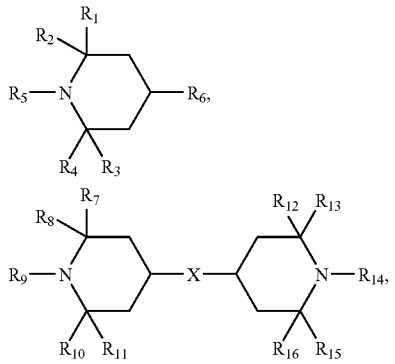

where $R_1$, $R_2$, $R_3$, $R_4$, $R_6$, $R_7$, $R_8$, $R_{10}$, $R_{11}$, $R_{12}$, $R_{13}$, $R_{14}R_{15}$ are, each independently, hydrogen, alkyl group, or ester, or ether group; and $R_5$, $R_9$, and $R_{14}$ are, each independently, alkyl group; and X is a linking group selected from the group consisting of —O—CO—$(CH_2)_m$—CO—O— where m is between 2 to 20.

The binder generally is capable of dispersing or dissolving the charge transport material (in the case of the charge transport layer or a single layer construction), the charge generating compound (in the case of the charge generating layer or a single layer construction) and/or an electron transport compound for appropriate embodiments. Examples of suitable binders for both the charge generating layer and charge transport layer generally include, for example, poly(styrene-co-butadiene), poly(styrene-co-acrylonitrile), modified acrylic polymers, poly(vinyl acetate), styrene-alkyd resins, soya-alkyl resins, poly(vinylchloride), poly(vinylidene chloride), polyacrylonitrile, polycarbonates, poly(acrylic acid), polyacrylates, polymethacrylates, styrene polymers, poly(vinyl butyral), alkyd resins, polyamides, polyurethanes, polyesters, polysulfones, polyethers, polyketones, phenoxy resins, epoxy resins, silicone resins, polysiloxanes, poly(hydroxyether) resins, polyhydroxystyrene resins, novolak, poly(phenylglycidyl ether-co-dicyclopentadiene), copolymers of monomers used in the above-mentioned polymers, and combinations thereof. Specific suitable binders include, for example, polyvinyl butyral, polycarbonate, and polyester. Non-limiting examples of polyvinyl butyral include BX-1 and BX-5 from Sekisui Chemical Co. Ltd., Japan. Non-limiting examples of suitable polycarbonate include polycarbonate A which is derived from bisphenol-A (e.g. IUPILON™ A from Mitsubishi Engineering Plastics, or LEXAN™ 145 from General Electric); polycarbonate Z which is derived from cyclohexylidene bisphenol (e.g. IUPILON™ Z from Mitsubishi Engineering Plastics Corp, White Plain, N.Y.); and polycarbonate C which is derived from methylbisphenol A (from Mitsubishi Chemical Corporation). Non-limiting examples of suitable polyester binders include ortho-polyethylene terephthalate (e.g. OPET™ TR-4 from Kanebo Ltd., Yamaguchi, Japan).

Suitable optional additives for any one or more of the layers include, for example, antioxidants, coupling agents, dispersing agents, curing agents, surfactants, and combinations thereof.

The photoconductive element overall typically has a thickness from about 10 microns to about 45 microns. In the dual layer embodiments having a separate charge generating layer and a separate charge transport layer, charge generation layer generally has a thickness form about 0.5 microns to about 2 microns, and the charge transport layer has a thickness from about 5 microns to about 35 microns. In embodiments in which the charge transport material and the charge generating compound are in the same layer, the layer with the charge generating compound and the charge transport material generally has a thickness from about 7 microns to about 30 microns. In embodiments with a distinct electron transport layer, the electron transport layer has an average thickness from about 0.5 microns to about 10 microns and in further embodiments from about 1 micron to about 3 microns. In general, an electron transport overcoat layer can increase mechanical abrasion resistance, increases resistance to carrier liquid and atmospheric moisture, and decreases degradation of the photoreceptor by corona gases. A person of ordinary skill in the art will recognize that additional ranges of thickness within the explicit ranges above are contemplated and are within the present disclosure.

Generally, for the organophotoreceptors described herein, the charge generation compound is in an amount from about 0.5 to about 25 weight percent, in further embodiments in an amount from about 1 to about 15 weight percent, and in other embodiments in an amount from about 2 to about 10 weight percent, based on the weight of the photoconductive layer. The charge transport material is in an amount from about 10 to about 80 weight percent, based on the weight of the photoconductive layer, in further embodiments in an amount from about 35 to about 60 weight percent, and in other embodiments from about 45 to about 55 weight percent, based on the weight of the photoconductive layer. The optional second charge transport material, when present, can be in an amount of at least about 2 weight percent, in other embodiments from about 2.5 to about 25 weight percent, based on the weight of the photoconductive layer, and in further embodiments in an amount from about 4 to about 20 weight percent, based on the weight of the photoconductive layer. The binder is in an amount from about 15 to about 80 weight percent, based on the weight of the photoconductive layer, and in further embodiments in an amount from about 20 to about 75 weight percent, based on the weight of the photoconductive layer. A person of ordinary skill in the art will recognize that additional ranges within the explicit ranges of compositions are contemplated and are within the present disclosure.

For the dual layer embodiments with a separate charge generating layer and a charge transport layer, the charge generation layer generally comprises a binder in an amount from about 10 to about 90 weight percent, in further embodiments from about 15 to about 80 weight percent and in some embodiments in an amount from about 20 to about 75 weight percent, based on the weight of the charge generation layer. The optional charge transport material in the charge generating layer, if present, generally can be in an amount of at least about 2.5 weight percent, in further embodiments from about 4 to about 30 weight percent and in other embodiments in an amount from about 10 to about 25 weight percent, based on the weight of the charge generating layer. The charge transport layer generally comprises a binder in an amount from about 20 weight percent to about 70 weight percent and in further embodiments in an amount from about 30 weight percent to about 50 weight percent. A person of ordinary skill in the art will recognize that additional ranges of binder concentrations for the dual layer embodiments within the explicit ranges above are contemplated and are within the present disclosure.

For the embodiments with a single layer having a charge generating compound and a charge transport material, the photoconductive layer generally comprises a binder, a charge transport material, and a charge generation compound. The charge generation compound can be in an amount from about 0.05 to about 25 weight percent and in further embodiment in an amount from about 2 to about 15 weight percent, based on the weight of the photoconductive layer. The charge transport material can be in an amount from about 10 to about 80 weight percent, in other embodiments from about 25 to about 65 weight percent, in additional embodiments from about 30 to about 60 weight percent and in further embodiments in an amount from about 35 to about 55 weight percent, based on the weight of the photoconductive layer, with the remainder of the photoconductive layer comprising the binder, and optionally additives, such as any conventional additives. A single layer with a charge transport material and a charge generating compound generally comprises a binder in an amount from about 10 weight percent to about 75 weight percent, in other embodiments from about 20 weight percent to about 60 weight percent, and in further embodiments from about 25 weight percent to about 50 weight percent. Optionally, the layer with the charge generating compound and the charge transport material may comprise a second charge transport material. The optional second charge transport material, if present, generally can be in an amount of at least about 2.5 weight percent, in further embodiments from about 4 to about 30 weight percent and in other embodiments in an amount from about 10 to about 25 weight percent, based on the weight of the photoconductive layer. A person of ordinary skill in the art will recognize that additional composition ranges within the explicit compositions ranges for the layers above are contemplated and are within the present disclosure.

In general, any layer with an electron transport layer can advantageously further include a UV light stabilizer. In particular, the electron transport layer generally can comprise an electron transport compound, a binder, and an optional UV light stabilizer. An overcoat layer comprising an electron transport compound is described further in copending U.S. patent application Ser. No. 10/396,536 to Zhu et al. entitled, "Organophotoreceptor With An Electron Transport Layer," incorporated herein by reference. For example, an electron transport compound as described above may be used in the release layer of the photoconductors described herein. The electron transport compound in an electron transport layer can be in an amount from about 10 to about 50 weight percent, and in other embodiments in an amount from about 20 to about 40 weight percent, based on the weight of the electron transport layer. A person of ordinary skill in the art will recognize that additional ranges of compositions within the explicit ranges are contemplated and are within the present disclosure.

The UV light stabilizer, if present, in any one or more appropriate layers of the photoconductor generally is in an amount from about 0.5 to about 25 weight percent and in some embodiments in an amount from about 1 to about 10 weight percent, based on the weight of the particular layer. A person of ordinary skill in the art will recognize that additional ranges of compositions within the explicit ranges are contemplated and are within the present disclosure.

For example, the photoconductive layer may be formed by dispersing or dissolving the components, such as one or more of a charge generating compound, the charge transport material of this invention, a second charge transport material such as a charge transport compound or an electron transport compound, a UV light stabilizer, and a polymeric binder in organic solvent, coating the dispersion and/or solution on the respective underlying layer and drying the coating. In particular, the components can be dispersed by high shear homogenization, ball-milling, attritor milling, high energy bead (sand) milling or other size reduction processes or mixing means known in the art for effecting particle size reduction in forming a dispersion.

The photoreceptor may optionally have one or more additional layers as well. An additional layer can be, for example, a sub-layer or an overcoat layer, such as a barrier layer, a release layer, a protective layer, or an adhesive layer. A release layer or a protective layer may form the uppermost layer of the photoconductor element. A barrier layer may be sandwiched between the release layer and the photoconductive element or used to overcoat the photoconductive element. The barrier layer provides protection from abrasion to the underlayers. An adhesive layer locates and improves the adhesion between a photoconductive element, a barrier layer and a release layer, or any combination thereof. A sub-layer is a charge blocking layer and locates between the electrically conductive substrate and the photoconductive element. The sub-layer may also improve the adhesion between the electrically conductive substrate and the photoconductive element.

Suitable barrier layers include, for example, coatings such as crosslinkable siloxanol-colloidal silica coating and hydroxylated silsesquioxane-colloidal silica coating, and organic binders such as poly(vinyl alcohol), methyl vinyl ether/maleic anhydride copolymer, casein, poly(vinyl pyrrolidone), poly(acrylic acid), gelatin, starch, polyurethanes, polyimides, polyesters, polyamides, poly(vinyl acetate), poly(vinyl chloride), poly(vinylidene chloride), polycarbonates, poly(vinyl butyral), poly(vinyl acetoacetal), poly(vinyl formal), polyacrylonitrile, poly(methyl methacrylate), polyacrylates, poly(vinyl carbazoles), copolymers of monomers used in the above-mentioned polymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers, and mixtures thereof. The above barrier layer polymers optionally may contain small inorganic particles such as fumed silica, silica, titania, alumina, zirconia, or a combination thereof. Barrier layers are described further in U.S. Pat. No. 6,001,522 to Woo et al., entitled "Barrier Layer For Photoconductor Elements Comprising An Organic Polymer And Silica," incorporated herein by reference. The release layer topcoat may comprise any release layer composition known in the art. In some embodiments, the release layer is a fluorinated polymer, siloxane polymer, fluorosilicone polymer, silane, polyethylene, polypropylene, polyacrylate, or a combination thereof. The release layers can comprise crosslinked polymers.

The release layer may comprise, for example, any release layer composition known in the art. In some embodiments, the release layer comprises a fluorinated polymer, siloxane polymer, fluorosilicone polymer, polysilane, polyethylene, polypropylene, polyacrylate, poly(methyl methacrylate-co-methacrylic acid), urethane resins, urethane-epoxy resins, acrylated-urethane resins, urethane-acrylic resins, or a combination thereof. In further embodiments, the release layers comprise crosslinked polymers.

The protective layer can protect the organophotoreceptor from chemical and mechanical degradation. The protective layer may comprise any protective layer composition known in the art. In some embodiments, the protective layer is a fluorinated polymer, siloxane polymer, fluorosilicone polymer, polysilane, polyethylene, polypropylene, polyacrylate, poly(methyl methacrylate-co-methacrylic acid), urethane resins, urethane-epoxy resins, acrylated-urethane resins, urethane-acrylic resins, or a combination thereof. In some embodiments of particular interest, the protective layers are crosslinked polymers.

An overcoat layer may comprise an electron transport compound as described further in copending U.S. patent application Ser. No. 10/396,536, filed on Mar. 25, 2003 to Zhu et al. entitled, "Organoreceptor With An Electron Transport Layer," incorporated herein by reference. For example, an electron transport compound, as described above, may be used in the release layer of this invention. The electron transport compound in the overcoat layer can be in an amount from about 2 to about 50 weight percent, and in other embodiments in an amount from about 10 to about 40 weight percent, based on the weight of the release layer. A person of ordinary skill in the art will recognize that additional ranges of composition within the explicit ranges are contemplated and are within the present disclosure.

Generally, adhesive layers comprise a film forming polymer, such as polyester, polyvinylbutyral, polyvinylpyrrolidone, polyurethane, poly(methyl methacrylate), poly(hydroxy amino ether) and the like. Barrier and adhesive layers are described further in U.S. Pat. No. 6,180,305 to Ackley et al., entitled "Organic Photoreceptors for Liquid Electrophotography," incorporated herein by reference.

Sub-layers can comprise, for example, polyvinylbutyral, organosilanes, hydrolyzable silanes, epoxy resins, polyesters, polyamides, polyurethanes, cellulosics and the like. In some embodiments, the sub-layer has a dry thickness between about 20 Angstroms and about 20,000 Angstroms. Sublayers containing metal oxide conductive particles can be between about 1 and about 25 microns thick. A person of ordinary skill in the art will recognize that additional ranges of compositions and thickness within the explicit ranges are contemplated and are within the present disclosure.

The charge transport materials as described herein, and photoreceptors including these compounds, are suitable for use in an imaging process with either dry or liquid toner development. For example, any dry toners and liquid toners known in the art may be used in the process and the apparatus of this invention. Liquid toner development can be desirable because it offers the advantages of providing higher resolution images and requiring lower energy for image fixing compared to dry toners. Examples of suitable liquid toners are known in the art. Liquid toners generally comprise toner particles dispersed in a carrier liquid. The toner particles can comprise a colorant/pigment, a resin binder, and/or a charge director. In some embodiments of liquid toner, a resin to pigment ratio can be from 1:1 to 10:1, and in other embodiments, from 4:1 to 8:1. Liquid toners are described further in U.S. Patent Publications 2002/0128349, entitled "Liquid Inks Comprising A Stable Organosol," and 2002/0086916, entitled "Liquid Inks Comprising Treated Colorant Particles," and U.S. Pat. No. 6,649,316, entitled "Phase Change Developer For Liquid Electrophotography," all three of which are incorporated herein by reference.

Charge Transport Material

As described herein, an organophotoreceptor comprises a charge transport material having the formula:

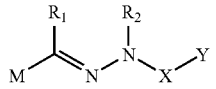

(I)

where M comprises a metallocenyl group;

Y comprises a functional group selected from the group consisting of a metallocenyl group, a hydrazone group, an azine group, a reactive ring group, such as an epoxy group, a thiiranyl group, an aziridinyl group, and an oxetanyl group, an ethylenically unsaturated group, such as a vinyl ether group, an alkenyl group, an acryloyl group, a methacryloyl group, an acrylamido group, and a methacrylamido group, and combinations thereof;

$R_1$ and $R_2$ comprise, each independently, H, an organic group, or an organometallic group such as a metallocenyl group; and X comprises a bond or a linking group such as O, S, an aminylene group (e.g., an NR group where R is H, an alkyl group, an alkenyl group, an alkynyl group, a carboxyl group, an acyl group, an aromatic group, or a heterocyclic group), a sulfonyl group, an organic linking group, and combinations thereof.

The organic group disclosed herein is a group that contains at least a carbon atom. The organic group may be monovalent, divalent, trivalent, tetravalent, etc. Non-limiting examples of the organic group include an alkyl group, an alkenyl group, an alkynyl group, an aromatic group, a heterocyclic group, and a part of a ring group, such as cycloalkyl groups, heterocyclic groups, and a benzo group. One or more of the hydrogen atoms in the alkyl, alkenyl, alkynyl, aromatic, heterocyclic, and ring group may be substituted with a non-hydrogen atom, such as halogens and alkali metals, or a polar or non-polar group such as a nitro group, a cyano group, a sulfonate group, a phosphonate group, a hydroxyl group, a thiol group, a carboxyl group, an amino group, an acyl group, an alkoxy group, an alkylsulfanyl group, an alkyl group, an alkenyl group, an alkynyl group, a heterocyclic group, and an aromatic group.

The organic linking group disclosed herein may be a divalent organic group linking at least two fragments of a chemical formula together. For example, the organic linking group X of Formula (I) links the Y group and the acyl-metallocenyl hydrazone group together. Some non-limiting examples of the divalent organic group include alkylene groups, arylene groups, carbonyl group, divalent aromatic groups, divalent heterocyclic groups, and combinations thereof. Another non-limiting example of the divalent organic group includes a $—(CH_2)_m—$ group, where m is an integer between 1 and 50, inclusive, and one or more of the methylene groups is optionally replaced by O, S, N, C, B, Si, P, C═O, O═S═O, a heterocyclic group, an aromatic group, an $NR_a$ group, a $CR_b$ group, a $CR_cR_d$ group, a $SiR_eR_f$ group, a $BR_g$ group, or a $P(═O)R_h$ group, where $R_a$, $R_b$, $R_c$, $R_d$, $R_e$, $R_f$, $R_g$, and $R_h$ are, each independently, a bond, H, a hydroxyl group, a thiol group, a carboxyl group, an amino group, a halogen, an acyl group, an alkoxy group, an alkylsulfanyl group, an alkenyl group, such as a vinyl group, an allyl group, and a 2-phenylethenyl group, an alkynyl group, a heterocyclic group, an aromatic group, a part of a ring group, such as cycloalkyl groups, heterocyclic groups, and a benzo group, or an alkyl group where one or more of the hydrogens of the alkyl group is optionally replaced by an aromatic group, a hydroxyl group, a thiol group, a carboxyl group, an amino group, or a halogen.

In some embodiments of interest, the organic linking group may have a valence of 3 or more and, therefore, may link 3 or more fragments of a chemical formula together. A non-limiting example of an organic linking group having a valence of 3 is a trivalent organic linking group created by replacing a methylene group in the $—(CH_2)_m—$ group with a $CR_b$ group. Another non-limiting example of an organic linking group having a valence of 4 is a tetravalent organic linking group created by replacing a methylene group in the $—(CH_2)_m—$ group with a carbon atom. Another non-limiting example of an organic linking group having a valence of 3 is a trivalent organic linking group created by replacing a methylene group in the $—(CH_2)_m—$ group with N, P, or B. A further non-limiting example of an organic linking group having a valence of 4 is a tetravalent organic linking group created by replacing two methylene groups in the $—(CH_2)_m—$ group with two $CR_b$ groups. Based on the disclosure herein, a person skill in the art may create an organic linking group having a valence greater than 2 by replacing at least one methylene group in the $—(CH_2)_m—$ group with at least an atom or a group having a valence of 3 or more, such as N, P, B, C, Si, a $CR_b$ group, an aromatic group having a valence greater than 2, and a heterocyclic group having a valence greater than 2.

In other embodiments of interest, the organic linking group may comprise at least an unsaturated bond, such as a $—CR_b═N—$ bond, a double bond or a triple bond. A non-limiting example of an organic linking group having a double bond is an unsaturated organic linking group created by replacing two adjacent methylene groups in the $—(CH_2)_m—$ group with two $CR_b$ groups. The double bond is located between the two adjacent $CR_b$ groups. Another non-limiting example of an organic linking group having a triple bond is an unsaturated organic linking group created by replacing two adjacent methylene groups in the $—(CH_2)_m—$ group with two carbon atoms respectively. The triple bond is located between the two adjacent carbon atoms. Another non-limiting example of an organic linking group having a $—CR_b═N—$ bond is an unsaturated organic linking group created by replacing two adjacent methylene groups in the $—(CH_2)_m—$ group with one $CR_b$ group and an N atom. Based on the disclosure herein, a person skill in the art may create an organic linking group having at least an unsaturated bond by replacing at least one pair of adjacent methylene groups in the $—(CH_2)_m—$ group, each independently, with an atom or a group selected from the group consisting of N, P, B, C, Si, a $CR_b$ group, an aromatic group having a valence greater than 2, and a heterocyclic group having a valence greater than 2.

The organometallic group disclosed herein is a group having at least one metal-carbon bond between an organic molecule, ion, or radical and a metal. Non-limiting examples of the organometallic group include metallocenyl groups.

The metallocenyl group disclosed herein is a metal complex comprising a positively charged metal ion chemically bonded to one or two negatively charged cyclopentadienide ions. Non-limiting examples of the metallocenyl group include a ferrocenyl group, a nickelocenyl group, a cobaltocenyl group, a zirconocenyl group, a ruthenocenyl group, a chromocenyl group, a hafnocenyl group, a titanocenyl group, a molybdenocenyl group, a niobocenyl group, a tungstenocenyl group, and a vanadocenyl group. The metallocenyl group may comprise two or more metallocenyl groups linked together through an organic linking group. Furthermore, the cyclopentadienide ion(s) of the metallocenyl group may be bridged and/or substituted. Non-limiting examples of suitable substituents on the cyclopentadienide ion ring include a silyl group, an alkyl group, an aryl group, an alkenyl group, and a part of a ring group, such as cycloalkyl groups, heterocyclic groups, and a benzo group. Non-limiting examples of suitable bridging group linking two cyclopentadienide ions together include a silylene group, an alkylene group, an arylene group, and combinations thereof. Furthermore, the metal ion of the metallocenyl group may bond to at least another anion or group such as hydride, halides, an alkyl group, an aryl group, and an alkene group.

In some embodiments of interest, M comprises a ferrocenyl group. In other embodiments of interest, Y is a reactive ring group such as an epoxy group. In further embodiments of interest, Y comprises at least an acyl-metallocene hydrazone group having Formula (II):

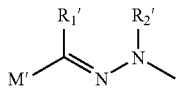

(II)

where M' comprises a metallocenyl group; and $R_1'$ and $R_2'$ comprise, each independently, H, an organic group, or an organometallic group such as a metallocenyl group.

In other embodiments of interest, M' is a ferrocenyl group. In further embodiments of interest, when Y of Formula (I) comprises an acyl-metallocene hydrazone group of Formula (II), X of Formula (I) comprises an alkylene group, an arylene group, an alkarylene group, an ether group, a carbonyl group, a sulfonyl group, or a formula selected from the group consisting of the formulae:

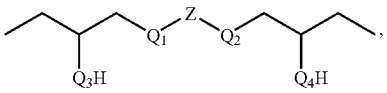

(III-A)

$$—(CH_2)_n—,$$

(III-B)

$$—(CH_2)_o—Q_5—(CH_2)_p—, \text{ and}$$

(III-C)

$$—(CH_2)_q—Q_6—(CH_2)_r—Q_7—(CH_2)_s—,$$

(III-D)

where $Q_1$, $Q_2$, $Q_3$, $Q_4$, $Q_5$, $Q_6$, and $Q_7$ are, each independently, a bond, O, S, or $NR_3$ where $R_3$ is H or an organic group, such as an alkyl group, an acyl group, an alkenyl group, an alkynyl group, a heterocyclic group, and an aromatic group; Z comprises a bond or a linking group, such as a carbonyl group, a sulfonyl group; an alkylene group, an ether group, an aromatic group, a heterocyclic group, and combinations thereof; and n, o, p, q, r, and s are, each independently, an integer between 1 and 10. In additional embodiments of interest, Z is selected from the group consisting of the formulae:

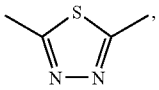

(IV)

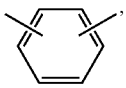

(V)

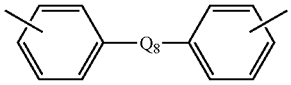

(VI)

where $Q_8$ is a bond, O, S, an alkylene, an arylene group, a carbonyl group, a sulfonyl group, or $NR_4$, and $R_4$ is H or an organic group, such as an alkyl group, an acyl group, an alkenyl group, an alkynyl group, a heterocyclic group, and an aromatic group. The two bonds in Formulae (V) or (VI) may locate in any two positions on one phenylene ring or separately on two phenylene rings. Some charge transport compounds having Formula (I) where Y comprises an acylmetallocene hydrazone group of Formula (II) may be represented by Formula (VII):

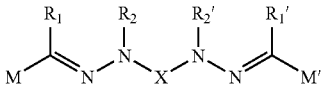

(VII)

where M and M' comprise each independently a metallocenyl group; $R_1$, $R_2$, $R_1'$, and $R_2'$ comprise, each independently, H, an organic group, or an organometallic group; and X is a bond or a linking group such as O, S, an aminylene group, a sulfonyl group, an organic linking group, and combinations thereof In some embodiments of interest, $R_1$, $R_2$, $R_1'$, and $R_2'$ comprise, each independently, H, an alkyl group, an alkenyl group, an alkynyl group, an aromatic group, a heterocyclic group, a part of a ring group, a hydrazone group, an azine group, a reactive ring group, such as an epoxy group, a thiiranyl group, an aziridinyl group, and an oxetanyl group, an ethylenically unsaturated group, such as a vinyl ether group, an alkenyl group, an acryloyl group, a methacryloyl group, an acrylamido group, and a methacrylamido group, or a combination thereof In other embodiments of interest, $R_2$ and $R_2'$ comprise, each independently, a reactive ring group such as an epoxy group and a 2,3-epoxypropyl group. In further embodiments of interest, X of Formula (VII) is selected from the group consisting of an alkylene group, an arylene group, an alkarylene group, an ether group, Formulae (III-A), (III-B), (III-D), and (Ill-F), and combinations thereof.

In additional embodiments of interest, M in Formula (I) or M' in Formula (II) comprise, each independently, at least a substituent having the formula:

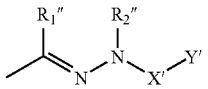

(VIII)

where Y' comprises a functional group selected from the group consisting of a metallocenyl group, a hydrazone group, an azine group, a reactive ring group, such as an epoxy group, a thiiranyl group, an aziridinyl group, and an oxetanyl group, an ethylenically unsaturated group, such as a vinyl ether group, an alkenyl group, an acryloyl group, a methacryloyl group, an acrylamido group, and a methacrylamido group, and combinations thereof; $R_1''$ and $R_2''$ comprise, each independently, H, an organic group, or an organometallic group such as a metallocenyl group; and X' is a bond or a linking group such as O, S, an aminylene group, a sulfonyl group, an organic linking group, and combinations thereof. Some charge transport compounds having Formula (I) wherein M comprises at least a substitutent having Formula (VIII) may be represented by the formula:

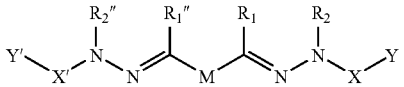

(IX)

where $R_1$, $R_2$, $R_1''$, and $R_2''$ comprise, each independently, H, an organic group, or an organometallic group; X and X' are, each independently, a bond or a linking group such as O, S, an aminylene group, a sulfonyl group, an organic linking group, and combinations thereof; M comprises a metallocenyl group; and Y and Y' comprise, each independently, a functional group selected from the group consisting of a metallocenyl group, a hydrazone group, an azine group, a reactive ring group, such as an epoxy group, a thiiranyl group, an aziridinyl group, and an oxetanyl group, an ethylenically unsaturated group, such as a vinyl ether group, an alkenyl group, an acryloyl group, a methacryloyl group, an acrylamido group, and a methacrylamido group, and combinations thereof. In some embodiments of interest, Y and Y' comprise, each independently, a reactive ring group, such as an epoxy group. In other embodiments of interest, $R_1$, $R_2$, $R_1''$, and $R_2''$ comprise, each independently, H, an alkyl group, an aryl group, an aromatic group, a heterocyclic group, or a combination thereof.

In further embodiments of interest, referring to Formula (VII), one hydrogen in M and one hydrogen in M' together are substituted with a divalent organic group to form a cyclic compound, such as Compounds (13)-(16) below. Non-limiting example of suitable divalent organic group for forming a cyclic compound include an alkylene group, an arylene group, an alkarylene group, a divalent heterocyclic group, a divalent aromatic group, and a group having Formula (X):

(X)

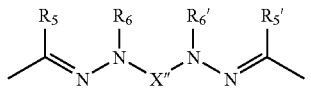

where $R_5$, $R_6$, $R_5'$, and $R_6'$ comprise, each independently, H, an organic group, or an organometallic group such as a metallocenyl group; and X" is a linking group such as O, S, an aminylene group, a sulfonyl group, an organic linking group, and combinations thereof. Such charge transport materials of Formula (VII) wherein M and M' together comprise a divalent organic group of Formula (X) can be represented by Formula (XI):

(XI)

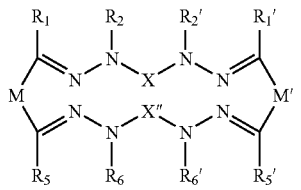

where $R_1$, $R_2$, $R_1'$, $R_2'$, $R_5$, $R_6$, $R_5'$, and $R_6'$ comprise, each independently, H, an organic group, or an organometallic group such as a metallocenyl group; X and X" are, each independently, a linking group such as O, S, an aminylene group, a sulfonyl group, an organic linking group, and combinations thereof; and M and M' comprise, each independently, a metallocenyl group. In some embodiments of interest, X and X" may be selected, each independently, from the group consisting of an alkylene group, an arylene group, an alkarylene group, an ether group, Formulae (III-A), (III-B), (III-D), and (III-E), and combinations thereof.

In other embodiments of interest, X of Formula (VII) comprises Formula (VI):

(VI)

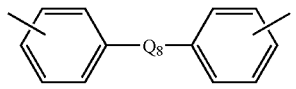

where $Q_8$ is a bond, O, S, an alkylene, an arylene group, a carbonyl group, a sulfonyl group, or $NR_4$, and $R_4$ is H or an organic group. The two bonds in Formula (VI) may locate in any two positions on one phenylene ring or separately on two phenylene rings. Such charge transport materials of Formula (VII) wherein X comprises Formula (VI) can be represented by Formula (XIII):

(XIII)

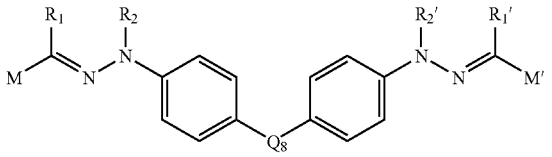

where $Q_8$ is a bond, O, S, an alkylene, an arylene group, a carbonyl group, a sulfonyl group, or $NR_4$, and $R_4$ is H or an organic group; M and M' comprise, each independently, a metallocenyl group; and $R_1$, $R_2$, $R_1'$, and $R_2'$ comprise, each independently, H, an organic group, or an organometallic group. In some embodiments of interest, $R_1$, $R_2$, $R_1'$, and $R_2'$ comprise, each independently, H, an alkyl group, an alkenyl group, an alkynyl group, an aromatic group, a heterocyclic group, or a part of a ring group, a hydrazone group, an azine group, a reactive ring group, such as an epoxy group, a thiiranyl group, an aziridinyl group, and an oxetanyl group, an ethylenically unsaturated group, such as a vinyl ether group, an alkenyl group, an acryloyl group, a methacryloyl group, an acrylamido group, and a methacrylamido group, or a combination thereof In other embodiments of interest, $R_2$ and $R_2'$ comprise, each independently, a reactive ring group such as a 2,3-epoxypropyl group. In further embodiments of interest, M and M' comprise, each independently, a ferrocenyl group and $Q_8$ is a sulfonyl group.

Another aspect of this invention features polymeric charge transport materials represented by Formula (XIV):

(XIV)

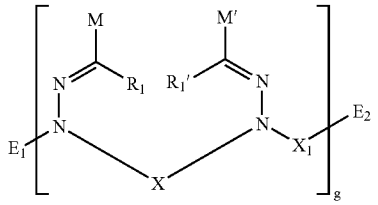

where M and M' comprise, each independently, a metallocenyl group; X and $X_1$ are, each independently, a linking group such as O, S, an aminylene group, a sulfonyl group, an organic linking group, and combinations thereof; $R_1$ and $R_1'$ comprise, each independently, H, an organic group, or an organometallic group; g is an average of a distribution of integers between 1 and 5,000; and $E_1$ and $E_2$ are each a terminal group. The terminal groups may vary between different polymer units depending on the state of the particular polymerization process at the end of the polymerization step. In general, the distribution of g values depends on the polymerization conditions. The presence of the polymer of Formula (XIV) does not preclude the presence of unreacted monomer within the organophotoreceptor, although the concentrations of monomer would generally be small if not extremely small or undetectable. The extent of polymerization, as specified with g, can affect the properties of the resulting polymer. In some embodiments, an average g value can be in the hundreds or thousands, although the average g may be any value greater than I and in some embodiments any value greater than 5. A person of ordinary skill in the art will recognize that additional ranges of average g values are contemplated and are within the present disclosure.

In some embodiments of interested, the charge transport materials of Formula (XIV) may be prepared by reacting a bridging compound having the formula $HQ_1$-Z-$Q_2H$, where Z comprises an organic linking group; $Q_1$ and $Q_2$ are, each independently, O, S, or $NR_3$ where $R_3$ is H or an organic group, with the charge transport material of Formula (VII) where $R_2$ and $R_2'$ comprise, each independently, a group, such as a 2,3-epoxypropyl group, that is reactive toward the -$Q_1H$ and -$Q_2H$ groups to form an $X_1$ group having the formula —$CH_2CH(OH)CH_2$-$Q_1$-Z-$Q_2$—$CH_2CH(OH)CH_2$—. Such charge transport materials may be represented by Formula (XIV-A):

(XIV-A)

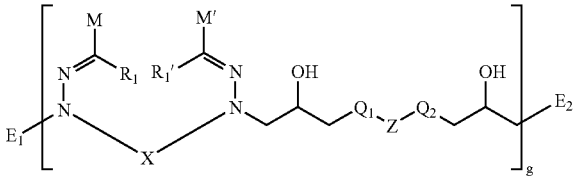

where M and M' comprise, each independently, a metallocenyl group; X is a linking group such as O, S, an aminylene group, a sulfonyl group, an organic linking group, and combinations thereof; $R_1$ and $R_1'$ comprise, each independently, H, an organic group, or an organometallic group; Z comprises a linking group such as O, S. an aminylene group, a sulfonyl group, a carbonyl group, an alkylene group, an arylene group, a divalent heterocyclic group, and combinations thereof; $Q_1$ and $Q_2$ are, each independently, a bond, O, S, or $NR_3$ where $R_3$ is H or an organic group; g is an average of a distribution of integers between 1 and 5,000; and $E_1$ and $E_2$ are each a terminal group. In some embodiments of interest, M and M' in Formulae (XIV) and (XIV-A) may be the same or different. In other embodiments of interest, $R_1$ and $R_1'$ in Formulae (XIV) and (XIV-A) may be the same or different. In further embodiments of interest, $E_1$ and $E_2$ in Formulae (XIV) and (XIV-A) may be the same or different. In additional embodiments of interest, $Q_1$ and $Q_2$ in Formula (XIV-A) may be the same or different.

Another aspect of this invention features polymeric charge transport materials represented by Formula (XV):

(XV)

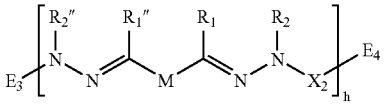

where $R_1$, $R_2$, $R_1''$, and $R_2''$ comprise, each independently, H, an organic group, or an organometallic group; $X_2$ is a linking group such as O, S, an aminylene group, a sulfonyl group, an organic linking group, and combinations thereof; M comprises a metallocenyl group; h is an average of a distribution of integers between 1 and 5,000; and $E_3$ and $E_4$ are each a terminal group.

In some embodiments of interested, polymeric charge transport materials of Formula (XV) may be prepared by reacting the charge transport material of Formula (IX) where Y and Y' are each an epoxy ring with a bridging compound having the formula $HQ_1$-Z-$Q_2H$ where Z comprises a linking group such as O, S, an aminylene group, a sulfonyl group, an organic linking group, and combinations thereof; $Q_1$ and $Q_2$ are, each independently, a bond, O, S, or $NR_3$ where $R_3$ is H or an organic group such as an alkyl group, an acyl group, an alkenyl group, an alkynyl group, a heterocyclic group, and an aromatic group to form an $X_2$ group having the formula —X—$CH(OH)CH_2$-$Q_1$-Z-$Q_2$-$CH_2CH(OH)$—X'—. Such polymeric charge transport materials may be represented by Formula (XV-A):

(XV-A)

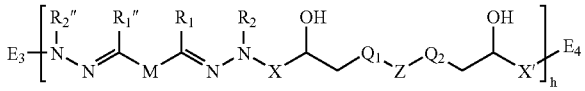

where $R_1$, $R_2$, $R_1''$, and $R_2''$ comprise, each independently, H, an organic group, or an organometallic group; M comprises a metallocenyl group; Z comprises a linking group such as O, S, an aminylene group, a sulfonyl group, an organic linking group, and combinations thereof; X and X' are, each independently, a bond or a linking group such as O, S, an aminylene group, a sulfonyl group, an organic linking group, and combinations thereof; $Q_1$ and $Q_2$ are, each independently, a bond, O, S, or $NR_3$ where $R_3$ is H or an organic group; h is an average of a distribution of integers between 1 and 5,000; and $E_3$ and $E_4$ are each a terminal group.

Alternatively, polymeric charge transport materials of Formula (XV) where $X_2$ is Z" may be prepared by reacting a diacyl-metallocene dihydrazone such as 1,1'-ferrocenedicarboxaldehyde bis(N-phenylhydrazone) with a cross-linking compound having the formula $L_1$-Z"-$L_2$ where Z" comprises a bond or a linking group such as O, S, an aminylene group, a sulfonyl group, an organic linking group, and combinations thereof; and $L_1$ and $L_2$ are each reactive toward the two N—H groups and may be selected from the group consisting of an isocyanate group, an acyl halide group, a carboxyl group, and a leaving group, such as mesylate, tosylate, and halides (i.e., fluoride, chloride, bromide, and iodide). Non-limiting examples of Z" include a bond, a carbonyl group, a —NH—C(═O)—, a sulfonyl group, an acyl halide group, an alkylene group, an alkenylene group, an ether group, an arylene group, an aromatic group, a heterocyclic group, and combinations thereof.

In some embodiments of interest, the hydrazone group ═N—N($R_2$)— in Formula (I) is replaced with an azine group ═N—N=group; X is a trivalent organic linking group double-bonded to one of the two azine nitrogens; and Y is an organic group. In other embodiments of interest, the trivalent organic linking group comprises an aromatic group. In other embodiments of interest, the hydrazone group ═N—N($R_2$)— in Formula (I) is replaced with an imine group; X is a bond or a divalent organic linking group; and Y is an organic group. In further embodiments of interest, the —C($R_1$)═N—N($R_2$)— group in Formula (I) is replaced with an imine group; X is a bond or a divalent organic linking group; and Y is an organic group. In additional embodiments of interest, the ═N—N($R_2$)—X—Y group in Formula (I) is replaced with an arylidene group or a divalent aromatic group.

Specific, non-limiting examples of suitable charge transport materials of the present invention include the following structures:

(1)
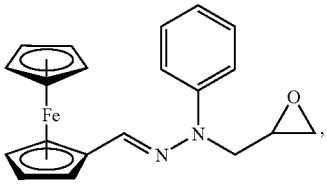
(2)
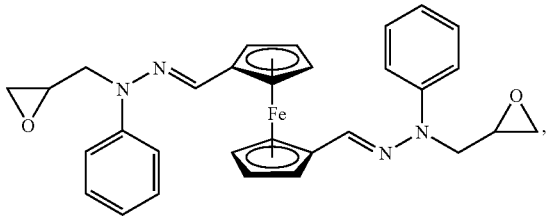
(3)
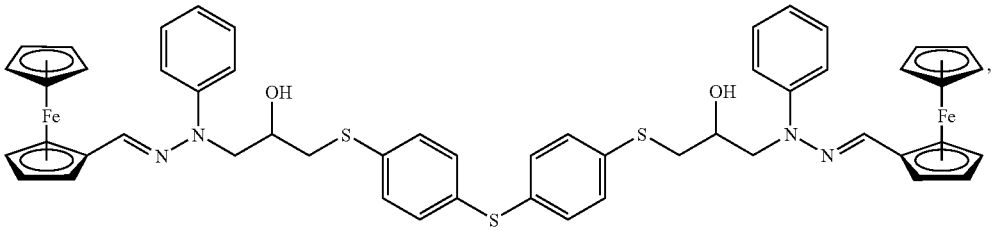
(4)
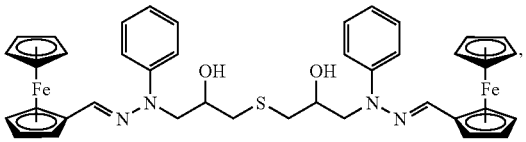
(5)
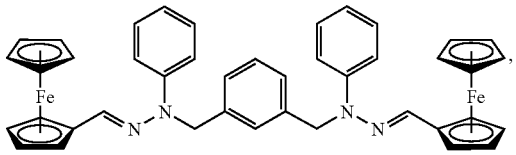
(6)
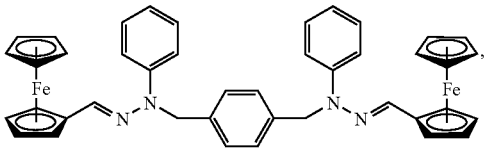
(7)
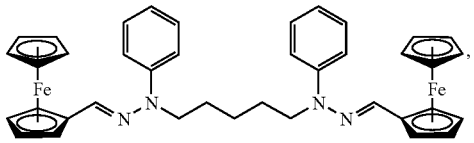
(8)
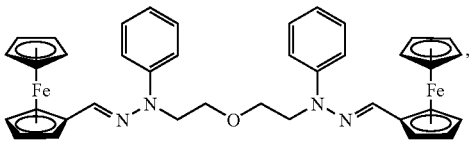
(9)
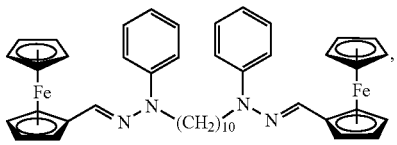
(10)
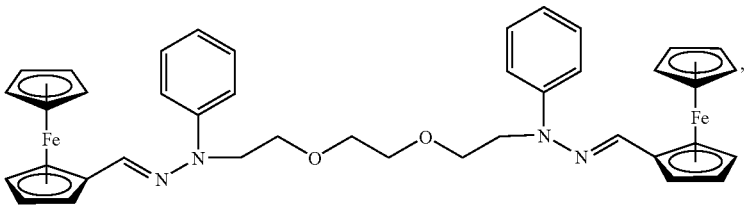
(11)
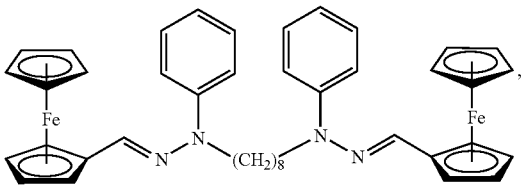
(12)
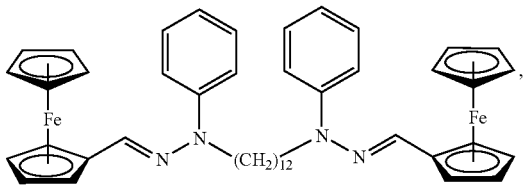

-continued
(13)
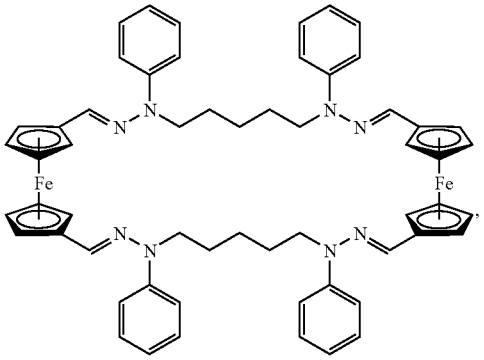
(14)
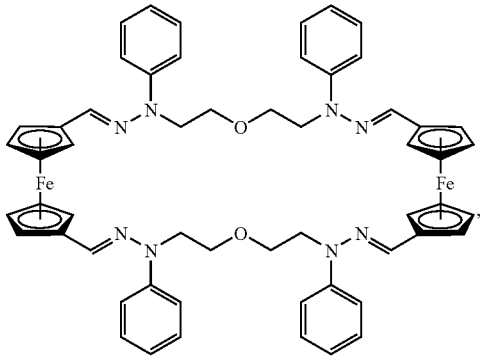
(15)
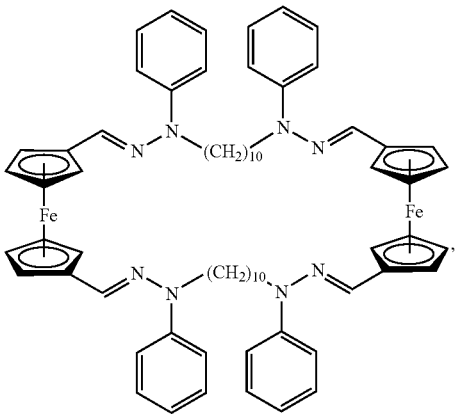
(16)
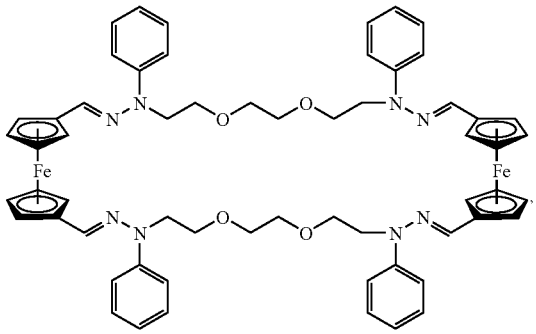
(17)
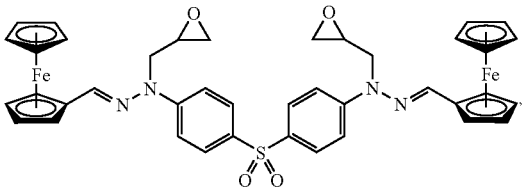
(18)
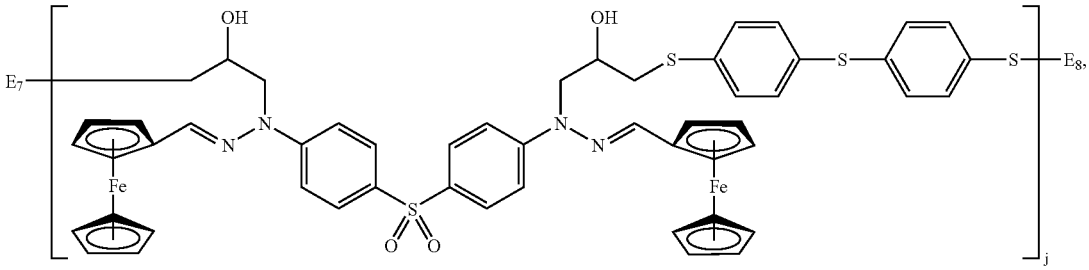
(19)
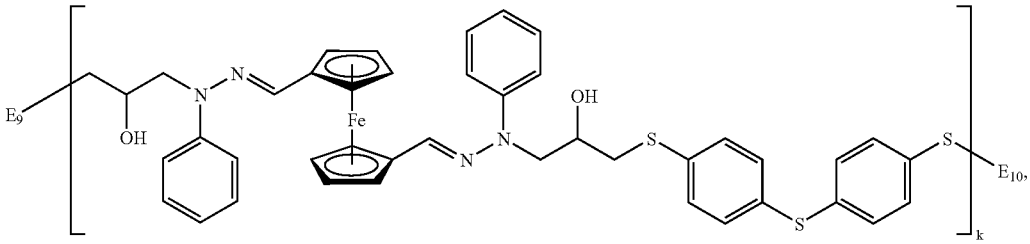

-continued
(20)
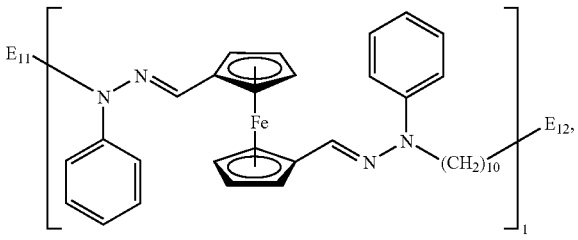
(21)
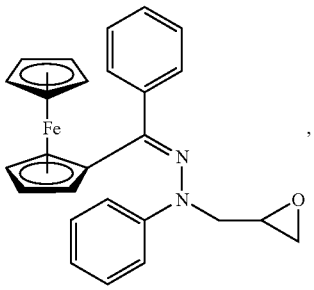
(22)
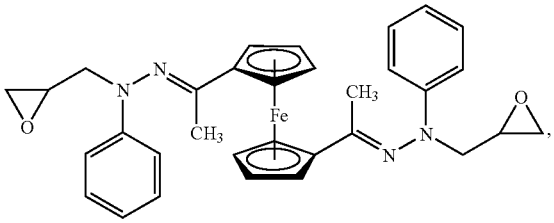
(23)
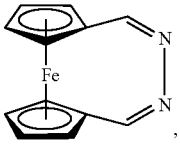
(24)
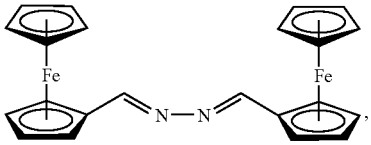
(25)
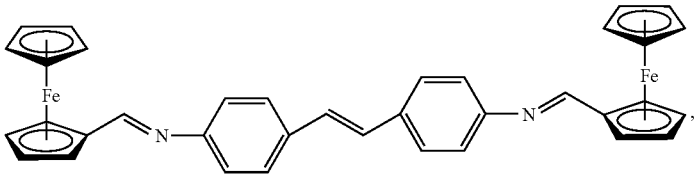
(26)
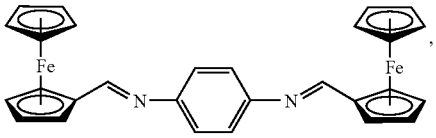
(27)
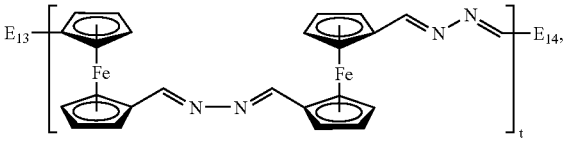
(28)
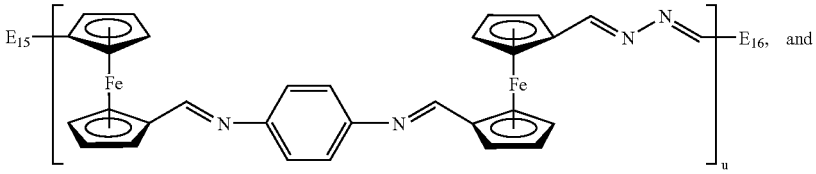
and -continued (29)

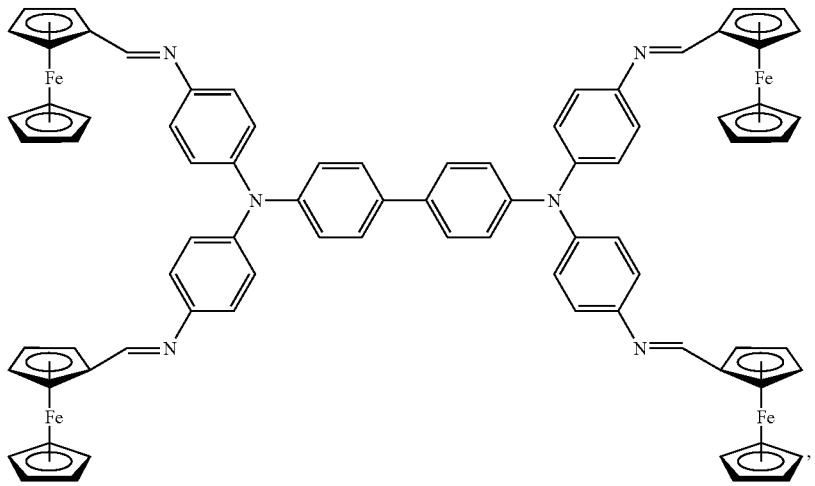

where j, k, l, t, and u are each an average of a distribution of integers between 1 and 5,000; and $E_7$, $E_8$, $E_9$, $E_{10}$, $E_{11}$, $E_{12}$, $E_{13}$, $E_{14}$, $E_{15}$, and $E_{16}$ are each a terminal group. The terminal groups $E_1$ to $E_{16}$ may vary between different polymer units depending on many factors such as the molar ratio of the starting materials, the presence or absence of a chain terminating agent, and the state of the particular polymerization process at the end of the polymerization step. Some unreacted starting materials may also present in the polymeric Compounds (18)-(20), and (27)-(28).

In general, the distribution of the g, h, j, k, l, t, and u values depends on various factors such as the molar ratio of the starting materials, the reaction time and temperature, the presence or absence of a chain terminating agent, the amount of an initiator if there is any, and the polymerization conditions. The presence of the polymeric charge transport material of Formula (II) does not preclude the presence of unreacted monomer within the organophotoreceptor, although the concentrations of monomer would generally be small if not extremely small or undetectable. The extent of polymerization, as specified with g, h, j, k, l, t, or u, can affect the properties of the respective polymer. In some embodiments of interest, the g, h, j, k, l, t, or u value is between 1 and 1000. In other embodiments of interest, the g, h, j, k, l, t, or u value is between 1 and 100. In further embodiments of interest, the g, h, j, k, l, t, or u value is between 1 and 50. In additional embodiments of interest, the g, h, j, k, l, t, or u value is between 1 and 10. A person of ordinary skill in the art will recognize that additional ranges of average n values are contemplated and are within the present disclosure.

In some embodiments of interest, each of Compounds (1)-(29), and Formulae (I)-(XV) above may further comprise at least a substituent. Non-limiting examples of suitable substituent include a hydroxyl group, a thiol group, an oxy group, a carboxyl group, an amino group, a halogen, an alkyl group, an acyl group, an alkoxy group, an alkylsulfanyl group, an alkenyl group, an alkynyl group, an ester group, an amido group, a nitro group, a cyano group, a sulfonate group, a phosphate, phosphonate, a heterocyclic group, an aromatic group, a hydrazone group, an enamine group, an azine group, an epoxy group, a thiiranyl group, an aziridinyl group, and a part of a ring group, such as cycloalkyl groups, heterocyclic groups, and a benzo group.

Synthesis of Charge Transport Materials

The synthesis of the charge transport materials of this invention can be prepared by the following multi-step synthetic procedures, although other suitable procedures can be used by a person of ordinary skill in the art based on the disclosure herein.

General Synthetic Procedure A for Charge Transport Materials of Formula (I)

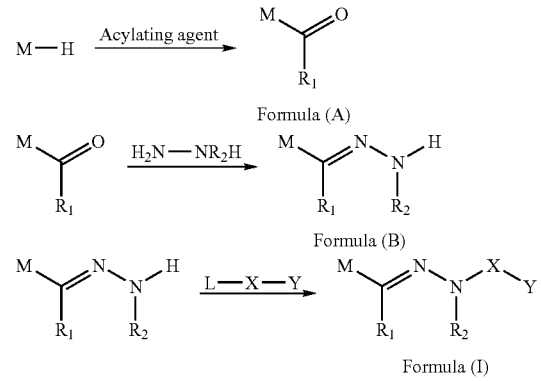

The acyl-metallocene of Formula (A) may be prepared by reacting the corresponding metallocene (M-H) with an acylating agent to substitute at least one hydrogen of the metallocene with an acyl group ($R_1CO$), where $R_1$ comprises H, an organic group, or an organometallic group. In some embodiments of interest, the metallocene is selected from the group consisting of ferrocene, nickelocene, cobaltocene, zirconocene, ruthenocene, chromocene, hafnocene, titanocene, molybdenocene, niobocene, tungstenocene, vanadocene and their derivatives. The above-mentioned metallocenes may further include at least a substituent on the pentadienide ion ring(s) or the metal ion. The substituent may be selected from the group consisting of a hydroxyl group, a thiol group, an oxy group, a carboxyl group, an amino group, a halogen, an alkyl group, an acyl group, an alkoxy group, an alkylsulfanyl group, an alkenyl group, an alkynyl group, an ester group, an amido group, a nitro group, a cyano group, a sulfonate group, a phosphate, phosphonate, a heterocyclic group, an aromatic group, a hydrazone group, an enamine group, an azine group, an epoxy group, a thiiranyl group, and an aziridinyl group.

Depending on the acylating agent, $R_1$ may comprise H, an organic group, or an organometallic group. Non-limiting examples of $R_1$ include an alkyl group, an alkenyl group, an alkynyl group, an aromatic group, a heterocyclic group, and a part of a ring group, such as cycloalkyl groups, heterocyclic groups, and a benzo group. The acylation of M-H may be done under Friedel-Crafts condition. For example, ferrocene can be acetylated with a mixture of phosphoric acid and acetic anhydride. Alternatively, the acylation of M-H may be done under Vilsmeier-Haack condition with a mixture of phosphorus oxychloride ($POCl_3$) and an N,N-dialkylamide, such as N,N-dimethylformamide, N,N-dimethylacetamide, and N,N-dimethylbenzamide. Alternatively, M-H may be acylated by an acyl chloride in the presence of the catalyst of bentonite-supported polytrifluoromethanesulfosiloxane (B-PTFMSS). In general, the acylated metallocene products from the above reactions include a mixture of acyl-metallocenes and diacyl-metallocenes. The acyl-metallocenes may be separated from the diacyl-metallocenes by conventional purification techniques, such as recrystallization and chromatography. The Friedel-Crafts acylation of ferrocene with B-PTFMSS and various acyl chlorides is described in Hu, et el., *Catalysis Letters*, October 2004, vol. 98, no. 1, pp. 43-47(5), which is incorporated herein by reference. Furthermore, the Friedel-Crafts acylation, Vilsmeier-Haack acylation, and related reactions are described in Carey et al., "Advanced Organic Chemistry, Part B: Reactions and Synthesis," New York, 1983, pp. 380-393, which is incorporated herein by reference. Some acyl-metallocenes such as ferrocenecarbaldehyde, acetylferrocene, and benzoylferrocene may be obtained from a commercial supplier, such as Aldrich.

The acyl-metallocene hydrazone of Formula (B) may be prepared by reacting the acyl-metallocene of Formula (A) with a hydrazine, $H_2N—NHR_2$ where $R_2$ comprises H, an organic group, or an organometallic group. Non-limiting examples of $R_2$ include an alkyl group, an alkenyl group, an aromatic group group, a heterocyclic group, or a part of a ring group, such as cycloalkyl groups, heterocyclic groups, and a benzo group. The hydrazone formation reaction may take place in a solvent, such as tetrahydrofuran and methanol. The hydrazone formation reaction may be catalyzed by an appropriate amount of acid, such as acetic acid, sulfuric acid and hydrochloric acid. The reaction mixture may be heated at an elevated temperature for a period of time, such as 2 to 14 hours. The acyl-metallocene hydrazone of Formula (B) may be isolated and purified by conventional purification techniques, such as chromatography and recrystallization.

The charge transport material of Formula (I) may be prepared by reacting the acyl-metallocene hydrazone of Formula (B) with a compound having the formula L-X—Y where Y comprises a functional group selected from the group consisting of a metallocenyl group, a hydrazone group, an azine group, a reactive ring group, such as an epoxy group, a thiiranyl group, an aziridinyl group, and an oxetanyl group, an ethylenically unsaturated group, such as a vinyl ether group, an alkenyl group, an acryloyl group, a methacryloyl group, an acrylamido group, and a methacrylamido group, and combinations thereof, X is a bond or a linking group such as O, S, an aminylene group, a sulfonyl group, an organic linking group, and combinations thereof, and L is reactive toward the N—H group and may be selected from the group consisting of a leaving group (e.g., halides, mesylate, and tosylate), an isocyanate group, an acyl halide group, and a carboxyl group. The compound having the formula L-X—Y will be discussed more fully later in General Synthetic Procedure B.

When L is a leaving group, the above substitution reaction may take place in a solvent, such as ethyl methyl ketone and tetrahydrofuran. The substitution reaction may be catalyzed by a base, such as potassium hydroxide, potassium carbonate, and a combination thereof. The reaction mixture may be heated at an elevated temperature for a period of time, such as 2 to 48 hours. When the reaction is completed, the charge transport material of Formula (I) may be isolated and purified by conventional purification techniques, such as chromatography and recrystallization.

General Synthetic Procedure B for Charge Transport Materials of Formula (IX)

In some embodiments of interest, M in Formula (I) comprises at least a substituent having the formula:

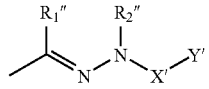

(VIII)

and such charge transport compounds may be represented by Formula (IX):

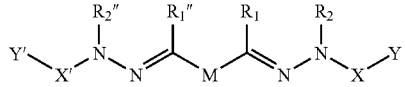

(IX)

where $R_1$, $R_2$, $R_1''$, and $R_2''$ comprise, each independently, H, an organic group, or an organometallic group; X and X' are, each independently, a bond or a linking group such as O, S, an aminylene group, a sulfonyl group, an organic linking group, and combinations thereof; M comprises a metallocenyl group; and Y and Y' comprise, each independently, a functional group selected from the group consisting of a metallocenyl group, a hydrazone group, an azine group, a reactive ring group, such as an epoxy group, a thiiranyl group, an aziridinyl group, and an oxetanyl group, an ethylenically unsaturated group, such as a vinyl ether group, an alkenyl group, an acryloyl group, a methacryloyl group, an acrylamido group, and a methacrylamido group, and combinations thereof. In some embodiments of interest, Y and Y' comprise, each independently, a reactive ring group, such as an epoxy group. The charge transport compounds of Formula (IX) may be prepared by the following procedure.

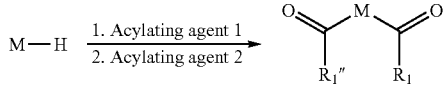

Formula (C)

-continued

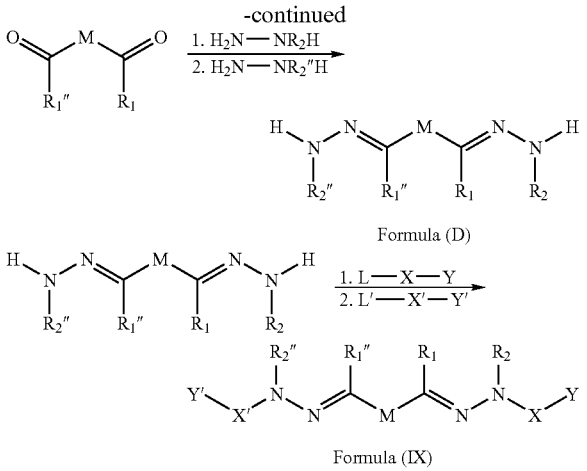

The diacyl-metallocene of Formula (C) may be prepared by reacting the corresponding metallocene (M-H) with one or two acylating agents to substitute two hydrogens of the metallocene with two acyl group (i.e., $R_1CO$ and $R_1$"CO and $R_1$=$R_1$" if one acylating agent is used), where $R_1$ and $R_1$" comprise, each independently, H, an organic group, or an organometallic group. $R_1$ and $R_1$" may the same or different. If $R_1$ and $R_1$" are the same, only one acylating agent is required. If $R_1$ and $R_1$" are different, two different acylating agents are required and they may react with M-H simultaneously or sequentially. In some embodiments of interest, the metallocene is selected from the group consisting of ferrocene, nickelocene, cobaltocene, zirconocene, ruthenocene, chromocene, hafnocene, titanocene, molybdenocene, niobocene, tungstenocene, vanadocene and their derivatives. The above-mentioned metallocenes may further include at least a substituent on the pentadienide ion ring(s) or the metal ion. The substituent may be selected from the group consisting of a hydroxyl group, a thiol group, an oxy group, a carboxyl group, an amino group, a halogen, an alkyl group, an acyl group, an alkoxy group, an alkylsulfanyl group, an alkenyl group, an alkynyl group, an ester group, an amido group, a nitro group, a cyano group, a sulfonate group, a phosphate, phosphonate, a heterocyclic group, an aromatic group, a hydrazone group, an enamine group, an azine group, an epoxy group, a thiiranyl group, and an aziridinyl group.

Depending on the acylating agent, $R_1$ and $R_1$" may comprise H, an organic group, or an organometallic group. Non-limiting examples of $R_1$ and $R_1$" include an alkyl group, an alkenyl group, an alkynyl group, an aromatic group, a heterocyclic group, and a part of a ring group, such as cycloalkyl groups, heterocyclic groups, and a benzo group. The diacylation of M-H may be done under Friedel-Crafts condition. For example, ferrocene can be diacetylated with a mixture of phosphoric acid and acetic anhydride. Alternatively, the diacylation of M-H may be done under Vilsmeier-Haack condition with a mixture of phosphorus oxychloride ($POCl_3$) and an N,N-dialkylamide, such as N,N-dimethylformamide, N,N-dimethylacetamide, and N,N-dimethylbenzamide. Alternatively, M-H may be diacylated by an acyl chloride in the presence of the catalyst of bentonite-supported polytrifluoromethanesulfosiloxane (B-PTFMSS), which is incorporated herein by reference. In general, the acylated metallocene products from the above reactions include a mixture of acyl-metallocenes and diacyl-metallocenes. The diacyl-metallocenes may be separated from the acyl-metallocenes by conventional purification techniques, such as recrystallization and chromatography. The Friedel-Crafts acylation of ferrocene with B-PTFMSS and various acyl chlorides is described in Hu, et el., *Catalysis Letters*, October 2004, vol. 98, no. 1, pp. 43-47(5). Furthermore, the Friedel-Crafts acylation, Vilsmeier-Haack acylation, and related reactions are described in Carey et al., "Advanced Organic Chemistry, Part B: Reactions and Synthesis," New York, 1983, pp. 380-393, which is incorporated herein by reference. Some diacylated metallocenes such as 1,1'-ferrocenedicarbaldehyde, 1,1'-diacetylferrocene, and 1,1'-dibenzoylferrocene may be obtained from a commercial supplier, such as Aldrich.

The diacyl-metallocene dihydrazone of Formula (D) may be prepared by reacting the diacyl-metallocene of Formula (C) with one or more hydrazines, $H_2N$—$NHR_2$ and $H_2N$—$NHR_2$" where $R_2$ and $R_2$" each comprises H, an organic group, or an organometallic group. $R_2$ and $R_2$" may the same or different. If $R_2$ and $R_2$" are the same, only one hydrazine is required. If $R_2$ and $R_2$" are different, two different hydrazines are required and they can react with the diacyl-metallocene of Formula (C) simultaneously or sequentially. Non-limiting examples of $R_2$ and $R_2$" include an alkyl group, an alkenyl group, an aromatic group group, a heterocyclic group, or a part of a ring group, such as cycloalkyl groups, heterocyclic groups, and a benzo group. The hydrazone formation reaction may take place in a solvent, such as tetrahydrofuran and methanol. The hydrazone formation reaction may be catalyzed by an appropriate amount of acid, such as acetic acid, sulfuric acid and hydrochloric acid. The reaction mixture may be heated at an elevated temperature for a period of time, such as 2 to 14 hours. The diacy-metallocene dihydrazone of Formula (D) may be isolated and purified by conventional purification techniques, such as chromatography and recrystallization.

The charge transport material of Formula (IX) may be prepared by reacting the metallocene dihydrazone of Formula (D) with L-X—Y and L'-X'-Y' where Y and Y' comprise, each independently, a functional group selected from the group consisting of a metallocenyl group, a hydrazone group, an azine group, a reactive ring group, such as an epoxy group, a thiiranyl group, an aziridinyl group, and an oxetanyl group, an ethylenically unsaturated group, such as a vinyl ether group, an alkenyl group, an acryloyl group, a methacryloyl group, an acrylamido group, and a methacrylamido group, and combinations thereof; X and X' are, each independently, a bond or a linking group such as O, S, an aminylene group, a sulfonyl group, an organic linking group, and combinations thereof; and L and L' are, each independently, a good leaving group, such as halides (e.g., fluoride, chloride, bromide, and iodide), mesylate and tosylate. L-X—Y and L'-X'-Y' may the same or different. If L-X—Y and L'-X'-Y' are different, they may react with the metallocene dihydrazone of Formula (D) simultaneously or sequentially.

When L and/or L' are a leaving group, the above substitution reaction may take place in a solvent, such as ethyl methyl ketone and tetrahydrofuran. The substitution reaction may be catalyzed by a base, such as potassium hydroxide, potassium carbonate, and a combination thereof. The reaction mixture may be heated at an elevated temperature for a period of time, such as 2 to 48 hours. When the reaction is completed, the charge transport material of Formula (IX) may be isolated and purified by conventional purification techniques, such as chromatography and recrystallization.

Some non-limiting examples of L-X—Y and L'-X'-Y' include vinyl chloroformate, isopropenyl chloroformate, vinyl chloroacetate, 2-chloroethyl vinyl ether, 6-(vinyloxy)-1-hexyl mesylate, 4-(vinyloxy)-1-butyl mesylate, 2-(vinyloxy)ethyl mesylate, 6-(vinyloxy)-1-hexyl tosylate, 4-(vinyloxy)-1-butyl tosylate, and 2-(vinyloxy)ethyl tosylate. The mesylates and tosylates can be prepared by the reaction between 6-(vinyloxy)-1-hexanol, 1,4-butanediol vinyl ether, and 2-(vinyloxy)ethanol with mesyl chloride and tosyl chloride respectively. The above-mentioned chemicals may be obtained commercially from a supplier such as Aldrich, Milwaukee, Wis.

Other non-limiting examples of L-X—Y and L'-X'-Y' include methacryloyl chloride, acryloyl chloride, crotonoyl chloride, 3-dimethylacryloyl chloride, cinnamoyl chloride, 2,6,6-trimethyl-1-cyclohexene-1-carbonyl chloride, 2,3,3-trichloroacryloyl chloride, 3-(2-chlorophenyl)-2-propenoyl chloride, 4-nitrocinnamoyl chloride, 3-(trifluoromethyl)cinnamoyl chloride, 2-[(dimethylamino)methylene]malonoyl dibromide, all of which may be obtained from commercial suppliers such as Aldrich.

Further non-limiting examples of L-X—Y and L'-X'—Y' include compounds having a reactive ring group. The reactive ring group may be selected from the group consisting of heterocyclic ring groups that have a higher strain energy than their corresponding open-ring structures. The conventional definition of strain energy is that it represents the difference in energy between the actual molecule and a completely strain-free molecule of the same constitution. More information about the origin of strain energy can be found in the article by Wiberg et al., "A Theoretical Analysis of Hydrocarbon Properties: II Additivity of Group Properties and the Origin of Strain Energy," *J. Am. Chem. Soc.* 109, 985 (1987), which is incorporated herein by reference. The heterocyclic ring group may have 3, 4, 5, 7, 8, 9, 10, 11, or 12 members, in further embodiments 3, 4, 5, 7, or 8 members, in some embodiments 3, 4, or 8 members, and in additional embodiments 3 or 4 members. Non-limiting examples of such heterocyclic ring are cyclic ethers (e.g., epoxides and oxetane), cyclic amines (e.g., aziridine), cyclic sulfides (e.g., thiirane), cyclic amides (e.g., 2-azetidinone, 2-pyrrolidone, 2-piperidone, caprolactam, enantholactam, and capryllactam), N-carboxy-α-amino acid anhydrides, lactones, and cyclosiloxanes. The chemistry of the above heterocyclic rings is described in George Odian, "Principle of Polymerization," second edition, Chapter 7, p. 508-552 (1981), which is incorporated herein by reference.

In some embodiments of interest, the reactive ring group is an epoxy group. A diamino-aromatic heterocyclic compound having an epoxy group may be prepared by reacting a corresponding compound with an organic halide comprising an epoxy group. Non-limiting examples of suitable organic halide comprising an epoxy group as the reactive ring group are epihalohydrins, such as epichlorohydrin. The organic halide comprising an epoxy group can also be prepared by the epoxidation reaction of the corresponding alkene having a halide group. Such epoxidation reaction is described in Carey et al., "Advanced Organic Chemistry, Part B: Reactions and Synthesis," New York, 1983, pp. 494-498, incorporated herein by reference. The alkene having a halide group can be prepared by the Wittig reaction between a suitable aldehyde or keto compound and a suitable Wittig reagent. The Wittig and related reactions are described in Carey et al., "Advanced Organic Chemistry, Part B: Reactions and Synthesis," New York, 1983, pp. 69-77, which is incorporated herein by reference.

In other embodiments of interest, the reactive ring group is a thiiranyl group. A diamino-aromatic heterocyclic compound having an epoxy group, such as those described above, can be converted into the corresponding thiiranyl compound by refluxing the epoxy compound and ammonium thiocyanate in tetrahydrofuran. Alternatively, the corresponding thiiranyl compound may be obtained by passing a solution of the above-described epoxy compound through 3-(thiocyano)propyl-functionalized silica gel (commercially available form Aldrich, Milwaukee, Wis.). Alternatively, a thiiranyl compound may be obtained by the thia-Payne rearrangement of a corresponding epoxy compound. The thia-Payne rearrangement is described in Rayner, C. M. Synlett 1997, 11; Liu, Q. Y.; Marchington, A. P.; Rayner, C. M. Tetrahedron 1997, 53, 15729; Ibuka, T. Chem. Soc. Rev. 1998, 27, 145; and Rayner, C. M. Contemporary Organic Synthesis 1996, 3, 499. All the above four articles are incorporated herein by reference.

In other embodiments of interest, the reactive ring group is an aziridinyl group. An aziridine compound may be obtained by the aza-Payne rearrangement of a corresponding diamino-aromatic heterocyclic compound having an epoxy group, such as one of those epoxy compounds described above. The thia-Payne rearrangement is described in Rayner, C. M. Synlett 1997, 11; Liu, Q. Y.; Marchington, A. P.; Rayner, C. M. Tetrahedron 1997, 53, 15729; and Ibuka, T. Chem. Soc. Rev. 1998, 27, 145. All the above three articles are incorporated herein by reference. Alternatively, an aziridine compound may be prepared by the addition reaction between a suitable nitrene compound and a suitable alkene. Such addition reaction is described in Carey et al., "Advanced Organic Chemistry, Part B: Reactions and Synthesis," New York, 1983, pp. 446-448, incorporated herein by reference.

In further embodiments of interest, the reactive ring group is an oxetanyl group. An oxetane compound may be prepared by the Paterno-Buchi reaction between a suitable carbonyl compound and a suitable alkene. The Paterno-Buchi reaction is described in Carey et al., "Advanced Organic Chemistry, Part B: Reactions and Synthesis," New York, 1983, pp. 335-336, which is incorporated herein by reference. 3-Chloromethyl-3-alkyloxetanes may be prepared according to the procedure disclosed in Japanese Publication No. 10-212282, which is incorporated herein by reference.

In additional examples, the reactive ring may be a 5 or 7-membered ring comprising a —COO— group or a —CONR— group, such as butyrolactone, N-methylbutyrolactam, N-methylcaprolactam, and caprolactone.

General Synthetic Procedure C for Charge Transport Materials of Formula (VII)

In some embodiments of interest, Y of Formula (I) comprises at least an acyl-metallocene hydrazone group having Formula (II):

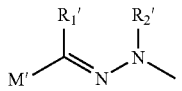

(II)

and such charge transport compounds may be represented by Formula (VII):

(VII)

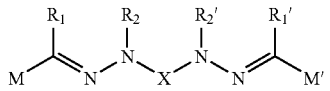

where M and M' comprise each independently a metallocenyl group; $R_1$, $R_2$, $R_1'$, and $R_2'$ comprise, each independently, H, an organic group, or an organometallic group; and X is a bond or a linking group such as O, S, an aminylene group, a sulfonyl group, an organic linking group, and combinations thereof. The charge transport compounds of Formula (VII) may be prepared by the following procedure.

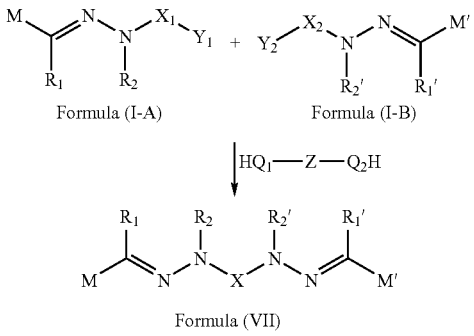

The charge transport materials of Formula (VII) may be prepared by reacting a bridging compound having the formula $HQ_1$-Z-$Q_2H$ with a compound of Formula (I-A) and a compound of Formula (I-B) either simultaneously or sequentially, where $X_1$, $X_2$, and Z are, each independently, a bond or a linking group such as O, S, an aminylene group, a sulfonyl group, an organic linking group, and combinations thereof; $Q_1$ and $Q_2$ are, each independently, a bond, O, S, or $NR_3$ where $R_3$ is H or an organic group; $Y_1$ and $Y_2$ are reactive towards the -$Q_1H$ and -$Q_2H$ groups and may be a reactive ring group such as an epoxy group; M and M' comprise each independently a metallocenyl group; and $R_1$, $R_2$, $R_1'$, and $R_2'$ comprise, each independently, H, an organic group, or an organometallic group. The reaction may be catalyzed with a base such as organic amines (e.g., triethylamine). X is the reaction product of the groups —$X_1$—$Y_1$, $HQ_1$-Z-$Q_2H$, and —$X_2$—$Y_2$. Based on the disclosure herein, any person skill in the art can vary X by changing the combination of —$X_1$—$Y_1$, $HQ_1$-Z-$Q_2H$, and —$X_2$—$Y_2$.

In some embodiments, when $X_1$ and $X_2$ are each a methylene group; and $Y_1$ and $Y_2$ are each independently an epoxy group, a thiiranyl group, or an aziridinyl group, X has the formula:

(III-A)

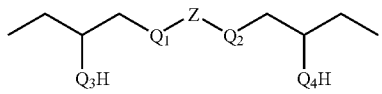

where $Q_1$, $Q_2$, $Q_3$, and $Q_4$ are, each independently, a bond, O, S, or $NR_3$ where $R_3$ is H or an organic group; and Z comprises a bond or a linking group such as O, S, an aminylene group, a sulfonyl group, an organic linking group, and combinations thereof, such as a carbonyl group, an alkylene group (e.g., Structure III-B when $Q_1$ and $Q_2$ are each a bond), an ether group (e.g., structures III-C and III-D when $Q_5$, $Q_6$ and $Q_7$ are each O and $Q_1$ and $Q_2$ are each independently a bond or O), an aromatic group, a heterocyclic group, and combinations thereof.

Both the compound of Formula (I-A) and the compound of Formula (I-B) may be prepared by the General Synthetic Procedure A mentioned above, which is incorporated herein by reference. The compound of Formula (I-A) and the compound of Formula (I-B) may be the same or different. The charge transport materials of Formula (VII) are symmetrical if the compound of Formula (I-A) and the compound of Formula (I-B) are the same and $HQ_1$-Z-$Q_2H$ is symmetrical. The bridged charge transport materials of Formula (VII) are unsymmetrical if the compound of Formula (I-A) and the compound of Formula (IB) are different or $HQ_1$-Z-$Q_2H$ is unsymmetrical. When Formula (I-A) is the same as Formula (I-B), the bridging compound may react with Formula (I-A) or Formula (I-B) in one step. When Formula (I-A) is different than Formula (I-B), the bridging compound may react with Formula (I-A) and Formula (I-B) sequentially.

In some embodiments, the bridging compound may be a diol, a dithiol, a diamine, a dicarboxylic acid, a hydroxylamine, an amino acid, a hydroxyl acid, a thiol acid, a hydroxythiol, or a thioamine. Non-limiting examples of suitable dithiol are 3,6-dioxa-1,8-octanedithiol, erythro-1,4-dimercapto-2,3-butanediol, (±)-threo-1,4-dimercapto-2,3-butanediol, 4,4'-thiobisbenzenethiol, 1,4-benzenedithiol, 1,3-benzenedithiol, sulfonyl-bis(benzenethiol), 2,5-dimecapto-1,3,4-thiadiazole, 1,2-ethanedithiol, 1,3-propanedithiol, 1,4-butanedithiol, 2,3-butanedithiol, 1,5-pentanedithiol, and 1,6-hexanedithiol. Non-limiting examples of suitable diols are 2,2'-bi-7-naphtol, 1,4-dihydroxybenzene, 1,3-dihydroxybenzene, 10,10-bis(4-hydroxyphenyl) anthrone, 4,4'-sulfonyldiphenol, bisphenol, 4,4'-(9-fluorenylidene)diphenol, 1,10-decanediol, 1,5-pentanediol, diethylene glycol, 4,4'-(9-fluorenylidene)-bis(2-phenoxyethanol), bis(2-hydroxyethyl) terephthalate, bis[4-(2-hydroxyethoxy)phenyl]sulfone, hydroquinone-bis (2-hydroxyethyl)ether, and bis(2-hydroxyethyl)piperazine. Non-limiting examples of suitable diamine are diaminoarenes, and diaminoalkanes. Non-limiting examples of suitable dicarboxylic acid are phthalic acid, terephthalic acid, adipic acid, and 4,4'-biphenyldicarboxylic acid. Non-limiting examples of suitable hydroxylamine are p-aminophenol and fluoresceinamine. Non-limiting examples of suitable amino acid are 4-aminobutyric acid, phenylalanine, and 4-aminobenzoic acid. Non-limiting examples of suitable hydroxyl acid are salicylic acid, 4-hydroxybutyric acid, and 4-hydroxybenzoic acid. Non-limiting examples of suitable hydroxythiol are monothiohydroquinone and 4-mercapto-1-butanol. Non-limiting example of suitable thioamine is p-aminobenzenethiol. Non-limiting example of suitable thiol acid are 4-mercaptobenzoic acid and 4-mercaptobutyric acid. Almost all of the above bridging compounds are available commercially from Aldrich and other chemical suppliers.

In further embodiments of interest, Z may be selected from the group consisting of the formulae:

(IV)

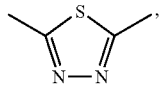

-continued (V)

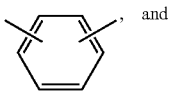

and (VI)

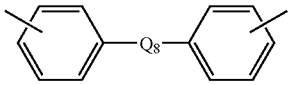

where $Q_8$ is a bond, O, S, an alkylene, an arylene group, a carbonyl group, a sulfonyl group, or $NR_4$, and $R_4$ is H or an organic group, such as an alkyl group, an acyl group, an alkenyl group, an alkynyl group, a heterocyclic group, and an aromatic group.

In other embodiments, the charge transport materials of Formula (VII) may be prepared by reacting a compound of Formula (I-A) with a compound of Formula (I-B) where $Y_1$ comprises a reactive ring group (or a reactive polar group such as hydroxyl, thiol, amino, and carboxyl) and $Y_2$ comprises a reactive polar group (or a reactive ring group). The reaction between the reactive ring group and the reactive polar group may be catalyzed by an organic base such as triethylamine.

General Synthetic Procedure D for Charge Transport Materials of Formula (XI)

In some embodiments, referring to Formula (VII), one hydrogen in M and one hydrogen in M' together are substituted with a divalent substituent to form a cyclic compound. The divalent substituent may be any divalent organic group, such as an alkylene group, an arylene group, an alkarylene group, a divalent heterocyclic group, a divalent aromatic group, and a group having Formula (X):

(X)

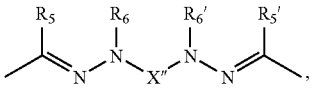

and such charge transport materials can be represented by Formula (XI):

(XI)

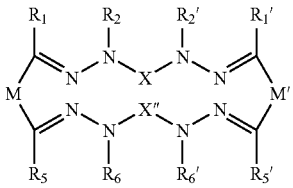

where $R_1$, $R_2$, $R_1'$, $R_2'$, $R_5$, $R_6$, $R_5'$, and $R_6'$ comprise, each independently, H, an organic group, or an organometallic group such as a metallocenyl group; X and X" are, each independently, a linking group such as O, S, an aminylene group, a sulfonyl group, an organic linking group, and combinations thereof; and M and M' comprise, each independently, a metallocenyl group. The charge transport materials of Formula (XI) may be prepared according to the following procedure.

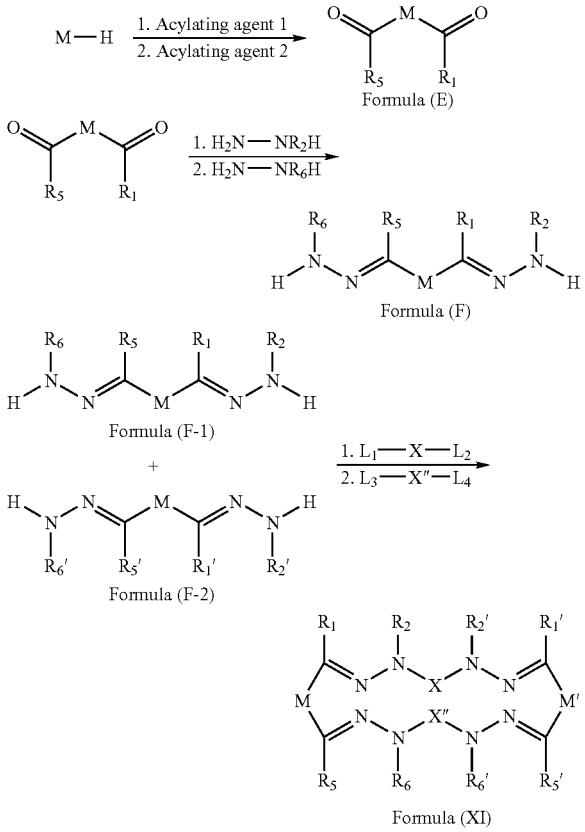

The diacyl-metallocene of Formula (E) may be prepared by reacting the corresponding metallocene (M-H) with one or two acylating agents to substitute two hydrogens of the metallocene with two acyl group (i.e., $R_1CO$ and $R_5CO$), where $R_1$ and $R_5$ comprise, each independently, H, an organic group, or an organometallic group. $R_1$ and $R_5$ may the same or different. If $R_1$ and $R_5$ are the same, only one acylating agent is required. If $R_1$ and $R_5$ are different, two different acylating agents are required and they may react with M-H simultaneously or sequentially. In some embodiments of interest, the metallocene is selected from the group consisting of ferrocene, nickelocene, cobaltocene, zirconocene, ruthenocene, chromocene, hafnocene, titanocene, molybdenocene, niobocene, tungstenocene, vanadocene and their derivatives. The above-mentioned metallocenes may further include at least a substituent on the pentadienide ion ring(s) or the metal ion. The substituent may be selected from the group consisting of a hydroxyl group, a thiol group, an oxy group, a carboxyl group, an amino group, a halogen, an alkyl group, an acyl group, an alkoxy group, an alkylsulfanyl group, an alkenyl group, an alkynyl group, an ester group, an amido group, a nitro group, a cyano group, a sulfonate group, a phosphate, phosphonate, a heterocyclic group, an aromatic group, a hydrazone group, an enamine group, an azine group, an epoxy group, a thiiranyl group, and an aziridinyl group.

Depending on the acylating agent, $R_1$ and $R_5$ may comprise H, an organic group, or an organometallic group. Non-limiting examples of $R_1$ and $R_5$ include an alkyl group, an alkenyl group, an alkynyl group, an aromatic group, a heterocyclic group, and a part of a ring group, such as cycloalkyl groups, heterocyclic groups, and a benzo group. The diacylation of M-H have been described in General Synthetic Procedure B, which is incorporated herein by reference.

The diacyl-metallocene dihydrazone of Formula (F) may be prepared by reacting the diacyl-metallocene of Formula (E) with one or more hydrazines, $H_2N—NHR_2$ and $H_2N—NHR_6$ where $R_2$ and $R_6$ each comprises H, an organic group, or an organometallic group. $R_2$ and $R_6$ may the same or different. If $R_2$ and $R_6$ are the same, only one hydrazine is required. If $R_2$ and $R_6$ are different, two different hydrazines are required and they can react with the diacyl-metallocene of Formula (E) simultaneously or sequentially. Non-limiting examples of $R_2$ and $R_6$ include an alkyl group, an alkenyl group, an aromatic group group, a heterocyclic group, or a part of a ring group, such as cycloalkyl groups, heterocyclic groups, and a benzo group. The hydrazone formation reaction may take place in a solvent, such as tetrahydrofuran and methanol. The hydrazone formation reaction may be catalyzed by an appropriate amount of acid, such as acetic acid, sulfuric acid and hydrochloric acid. The reaction mixture may be heated at an elevated temperature for a period of time, such as 2 to 14 hours. The diacyl-metallocene dihydrazone of Formula (F) may be isolated and purified by conventional purification techniques, such as chromatography and recrystallization.

The charge transport material of Formula (XI) may be prepared by reacting the diacyl-metallocene dihydrazone of Formula (F-1) and the diacyl-metallocene dihydrazone of Formula (F-2) with cross-linking compounds having the formula $L_1$-X-$L_2$ and $L_3$-X"-$L_4$ respectively where X and X" are, each independently, a bond or a linking group such as O, S, an aminylene group, a sulfonyl group, an organic linking group, and combinations thereof; and $L_1$, $L_2$, $L_3$, and $L_4$ are each reactive toward the two N—H groups and may be selected from the group consisting of a leaving group (e.g., halides, mesylate, and tosylate), an isocyanate group, an acyl halide group, and a carboxyl group. M comprises a metallocenyl group. The cross-linking compounds are discussed more fully later in General Synthetic Procedure G, which is incorporated herein by reference. $L_1$-X-$L_2$ and $L_3$-X"-$L_4$ may the same or different, and the metallocene dihydrazone of Formula (F-1) and the metallocene dihydrazone of Formula (F-2) may the same or different. If $L_1$-X-$L_2$ and $L_3$-X"-$L_4$ are different, they may react with the metallocene dihydrazone of Formula (F-1) and/or the metallocene dihydrazone of Formula (F-2) simultaneously or sequentially. Furthermore, if the metallocene dihydrazone of Formula (F-1) and the metallocene dihydrazone of Formula (F-2) are different, they may react with $L_1$-X-$L_2$ and/or $L_3$-X"-$L_4$ simultaneously or sequentially.

The above substitution reaction may take place in a solvent, such as ethyl methyl ketone and tetrahydrofuran. The substitution reaction may be catalyzed by a base, such as potassium hydroxide, potassium carbonate, and a combination thereof. The reaction mixture may be heated at an elevated temperature for a period of time, such as 2 to 48 hours. When the reaction is completed, the charge transport material of Formula (XI) may be isolated and purified by conventional purification techniques, such as chromatography and recrystallization.

General Synthetic Procedure E for Charge Transport Materials of Formula (XIV)

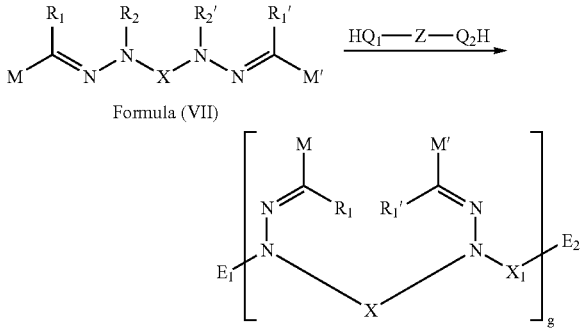

The charge transport materials of Formula (XIV) may be prepared by reacting a bridging compound having the formula $HQ_1$-Z-$Q_2H$, where Z comprises a linking group such as O, S, an aminylene group, a sulfonyl group, an organic linking group, and combinations thereof, $Q_1$ and $Q_2$ are, each independently, O, S, or $NR_{11}$ where $R_{11}$ is H or an organic group, with the charge transport material of Formula (VII) where $R_2$ and $R_2$' comprise, each independently, a group that is reactive toward the -$Q_1H$ and -$Q_2H$ groups. In some embodiments of interest, $R_2$ and $R_2$' comprise, each independently, a reactive ring group, a carboxyl group, an isocyanate group, or an ester group. M and M' comprise each independently a metallocenyl group. $R_1$ and $R_1$' comprise, each independently, H, an organic group, or an organometallic group. X is a bond or a linking group such as O, S, an aminylene group, a sulfonyl group, an organic linking group, and combinations thereof. $X_1$ is the reaction product of —$R_2$, $HQ_1$-Z-$Q_2H$, and —$R_2$'. $E_1$ and $E_2$ are each a terminal group and g is an average of a distribution of integers between 1 and 5,000.

In some embodiments of interest, Z may be selected from the group consisting of the formulae:

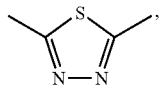

(IV)

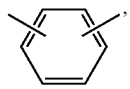

and (V)

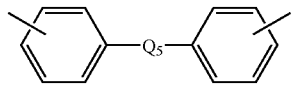

(VI)

where $Q_5$ is a bond, O, S, an alkylene, an arylene group, a carbonyl group, a sulfonyl group, or $NR_4$, and $R_4$ is H or an organic group, such as an alkyl group, an acyl group, an alkenyl group, an alkynyl group, a heterocyclic group, and an aromatic group.

In other embodiments of interest, $R_2$ and $R_2$' comprise, each independently, a 2,3-epoxypropyl group so that the reaction between a charge transport material of Formula (VII) and a bridging compound having the formula $HQ_1$-Z-$Q_2H$ to form the corresponding charge transport material of Formula (XIV) where $X_1$ is —$CH_2CH(OH)CH_2$-$Q_1$-Z-$Q_2$-$CH_2CH(OH)CH_2$—, which may be represented by Formula (XIV-A) below. The reaction may be catalyzed with a base such as organic amines (e.g., triethylamine).

(XIV-A)

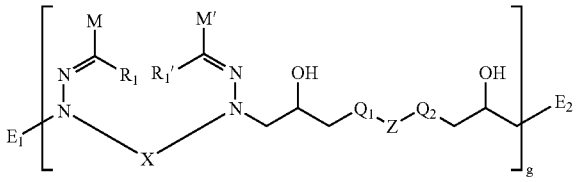

General Synthetic Procedure F for Charge Transport Materials of Formula (XV)

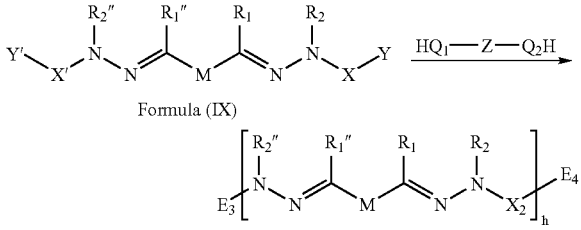

Formula (IX)

Formula (XV)

The charge transport materials of Formula (XV) may be prepared by reacting the charge transport material of Formula (IX) with a bridging compound having the formula $HQ_1$-Z-$Q_2H$ where Z comprises a linking group such as O, S, an aminylene group, a sulfonyl group, an organic linking group, and combinations thereof; $Q_1$ and $Q_2$ are, each independently, O, S, or $NR_{11}$ where $R_{11}$ is H or an organic group such as an alkyl group, an acyl group, an alkenyl group, an alkynyl group, a heterocyclic group, and an aromatic group. M comprises a metallocenyl group. $R_1$, $R_2$, $R_1$", and $R_2$" comprise, each independently, H, an organic group, or an organometallic group. X and X' of Formula (IX) are, each independently, a bond or a linking group such as O, S, an aminylene group, a sulfonyl group, an organic linking group, and combinations thereof. Y and Y' of Formula (IX) comprise, each independently, a functional group selected from the group consisting of a metallocenyl group, a hydrazone group, an azine group, a reactive ring group, such as an epoxy group, a thiiranyl group, an aziridinyl group, and an oxetanyl group, an ethylenically unsaturated group, such as a vinyl ether group, an alkenyl group, an acryloyl group, a methacryloyl group, an acrylamido group, and a methacrylamido group, and combinations thereof. $X_2$ is the reaction product of —X—Y, $HQ_1$-Z-$Q_2H$, and —X'—Y'. $E_3$ and $E_4$ are each a terminal group and h is an average of a distribution of integers between 1 and 5,000. The terminal groups $E_3$ and $E_4$ may vary between different polymer units depending on the state of the particular polymerization process at the end of the polymerization step.

In some embodiments of interest, Z may be selected from the group consisting of the formulae:

(IV)

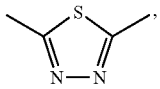

(V)

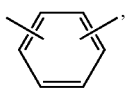

and (VI)

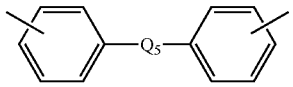

where $Q_5$ is a bond, O, S, an alkylene, an arylene group, a carbonyl group, a sulfonyl group, or $NR_4$, and $R_4$ is H or an organic group, such as an alkyl group, an acyl group, an alkenyl group, an alkynyl group, a heterocyclic group, and an aromatic group. In further embodiments of interest, Y and Y' comprise, each independently, an epoxy group so that the reaction between a charge transport material of Formula (IX) and a bridging compound having the formula $HQ_1$-Z-$Q_2H$ to form the corresponding charge transport material of Formula (XV) where $X_2$ is —$XCH(OH)CH_2$-$Q_1$-Z-$Q_2$-$CH_2CH(OH)X'$— which may be represented by the Formula (XV-A) below. The reaction may be catalyzed with a base such as organic amines (e.g., triethylamine).

(XV-A)

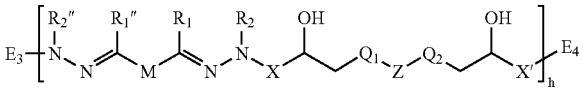

General Synthetic Procedure G for Charge Transport Materials of Formula (XV)

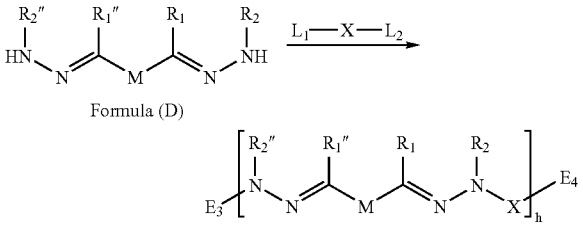

Formula (D)

Formula (XV) where $X_2$ = X

Alternatively, the charge transport materials of Formula (XV) may be prepared by reacting the charge transport material of Formula (D) with a cross-linking compound having the formula $L_1$-X-$L_2$ where X comprises a bond or a linking group such as O, S, an aminylene group, a sulfonyl group, an organic linking group, and combinations thereof; $L_1$ and $L_2$ are each reactive toward the two N—H groups and may be selected from the group consisting of a leaving group (e.g., halides, mesylate, and tosylate), an isocyanate group, an acyl halide group, and a carboxyl group. M comprises a metallocenyl group. $R_1$, $R_2$, $R_1$", and $R_2$" comprise, each independently, H, an organic group, or an organometallic group. $E_3$ and $E_4$ are each a terminal group and h is an average of a distribution of integers between 1 and 5,000.

In some embodiments of interest, X comprises a bond, a carbonyl group, a sulfonyl group, an acyl halide group, an alkylene group, an alkenylene group, an ether group, an aromatic group, a heterocyclic group, or a combination thereof. In other embodiments of interest, $L_1$ and $L_2$ are each a halide; and X comprises an alkylene group so that the cross-linking compound includes dihaloalkanes such as 1,5-dibromopentane, 1,8-dibromooctane, 1,10-dibromodecane, 1,6-dichlorohexane, 1,8-dichlorooctane, 1,10-dichlorodecane, 1,2-diiodoethane, 1,4-diiodobutane, and 1,10-diiododecane, all of which are available from a commercial supplier such as Aldrich, Milwaukee, Wis.

In further embodiments of interest, X comprises a bond, an alkylene group, an alkenylene group, an aromatic group, or a combination thereof; and $L_1$ and $L_2$ are each an acyl halide group so that the cross-linking compound includes diacyl halides such as oxalyl chloride, oxalyl bromide, malonyl chloride, succinyl chloride, glutaryl chloride, adipoyl chloride, pimeloyl chloride, suberoyl chloride, phthaloyl chloride, isophthaloyl chloride, terephthaloyl chloride, 1,4-phenylenediacryloyl chloride, and cinnamylidenemalonyl chloride, all of which are available from a commercial supplier such as Aldrich, Milwaukee, Wis.

In additional embodiments of interest, X comprises a carbonyl group or a sulfonyl group and $L_1$ and $L_2$ are each a halide so that the cross-linking compound may includes thionyl chloride, thionyl bromide and phosgene, all of which are available from a commercial supplier such as Aldrich, Milwaukee, Wis.

The invention will now be described further by way of the following examples.

EXAMPLES

Example 1

Synthesis and Characterization Charge Transport Materials

This example describes the synthesis and characterization of Compounds (1)-(29) in which the numbers refer to formula numbers above. The characterization involves chemical characterization of the compositions. The electrostatic characterization, such as mobility and ionization potential, of the materials formed with the compositions is presented in a subsequent example.

Compound (1)

Ferrocenecarboxaldehyde N-Phenylhydrazone. A mixture of ferrocenecarboxaldehyde (5.5 g, 0.0257 mole, obtained from Aldrich, Milwaukee, Wis.), and 10 ml of 2-propanol was added to a 100 ml, 2-neck round bottom flask equipped with a reflux condenser and a mechanical stirrer. The solution was stirred with heating until all solid entered into solution. A solution of N-phenylhydrazine (3.05 g, 0.0309 mole, obtained from Aldrich) in 5 ml of 2-propanol was added to the solution. After refluxed for 5 hours, the reaction mixture was cooled to room temperature. The crystals formed upon cooling were filtered off and washed with 2-propanol. The crude product was recrystallized from 2-propanol. The yield of ferrocenecarboxaldehyde N-phenylhydrazone was 6 g (77%). The melting point of the product was found to be 92-95° C. An infrared absorption spectrum of the product was characterized by the following absorption wave numbers (KBr windows, in $cm^{-1}$): 3309 (NH); 3089, 3050 (aromatic CH); 1599 (C═C, C—N); 748, 696 (CH═CH of monosubstituted benzene). An elemental analysis of the product was characterized by the following elements in weight percent: C 67.50; H 5.46; N 9.57, which compared with calculated values for $C_{17}H_{16}FeN_2$, in weight percent of: C 67.13; H 5.30; N 9.21.

A mixture of potassium hydroxide powder (KOH, 85%, 198 g, 3 mol) and anhydrous sodium sulfate ($Na_2SO_4$, 51 g, 0.369 mol) was added in three stages to a mixture of ferrocenecarboxaldehyde N-phenylhydrazone (1 mol) and epichlorohydrin (1.5 mol, from Aldrich, Milwaukee, Wis.), while keeping the reaction mixture at 35-40° C. In the first stage, 33 g of $Na_2SO_4$ and 66 g of KOH were added initially. In the second stage, 9.9 g of $Na_2SO_4$ and 66 g of KOH were added after 1 hour of reaction. In the third stage, 9.9 g of $Na_2SO_4$ and 66 g of KOH were added after 2 hours of reaction. After the reaction mixture was stirred vigorously at 35-40° C. for 6 hours, the reaction was terminated by diluting the reaction mixture with chloroform. The organic layer was separated and washed with water until the washed water reached a neutral pH. The organic layer was collected, dried over anhydrous magnesium sulfate, treated with activated charcoal, and filtered. After the solvents were removed from the organic filtrate, the residue was purified by column chromatography using silica gel (grade 62, 60-200 mesh, 150 Å, Aldrich) and an eluant mixture of ethyl acetate and hexane in 3:22 ratio by volume. The yield of Compound (1) was 5.3 g (44.8%). Compound (1) was further recrystallized from 2-propanol. The melting point of the purified Compound (1) was found to be 115-117° C. An infrared absorption spectrum of the product was characterized by the following absorption wave numbers (KBr windows, in $cm^{-1}$): 3077, 3061, 3038 (aromatic CH); 2996, (aliphatic CH); 1592, 1490 (C═C); 1262, 932, 836 (stretching vibrations assigned to the C—O linkage in epoxy group); 752, 695 (CH═CH of monosubstituted benzene). A $^1$H-NMR spectrum (300 MHz) of the product in $CDCl_3$ was characterized by the following chemical shifts (δ, ppm): 7.51 (s, 1H, CH═N); δ=7.36-7.24 (m, 4H, Ph); δ=6.96-6.88 (m, 1H, 4-H Ph); δ=4.66-4.58 (m, 2H, ferrocene-H); δ=4.33-4.25 (m, 2H, ferrocene-H, 1H, $NCH_2$); δ=4.16 (s, 5H, ferrocene-H); δ=3.89 (dd, 1H, part of ABX system, trans-$H_A$ of $NCH_2$, $J_{AX}$=4.1 Hz, $J_{AB}$=15.7 Hz); δ=3.30-3.24 (m, 1H, CH); δ=2.86 (dd, 1H, part of ABX system, cis-$H_A$ of epoxy $CH_2$, $J_{AX}$=2.6 Hz, $J_{AB}$=4.6 Hz); δ=2.63 (dd, 1H, part of ABX system, trans-$H_B$ of $OCH_2$, $J_{BX}$=3.6 Hz). An elemental analysis of the product was characterized by the following elements in weight percent: C 66.72; H 5.36; N 7.68, which compared with calculated values for $C_{20}H_{20}FeN_2O$, in weight percent of: C 66.68; H 5.20; N 7.78.

Compound (2)

Compound (2) may be prepared according to the procedure for Compound (1) except that ferrocenecarboxaldehyde is replaced with 1,1'-ferrocenedicarboxaldehyde (available form Aldrich, Milwaukee, Wis.) and the amount of 1,1'-ferrocenedicarboxaldehyde and the intermediate, 1,1'-ferrocenedicarboxaldehyde bis(N-phenylhydrazone), are reduced by 50%.

Compound (3)

Compound (1) (2.25 g, 6.246 mmole), a solution of 4,4'-thiobisbenzenethiol (0.78 g, 3.123 mmole, from Aldrich chemicals) in 15 ml of tetrahydrofuran (THF), and triethylamine (0.316 g, 0.42 ml, 3.123 mmole, from Aldrich, Milwaukee, Wis.) were added sequentially to a 100 ml 3-neck round bottom flask. The reaction mixture was refluxed for 2 hours. After the completion of the reaction, the product was purified by column chromatography using silica gel (grade 62, 60-200 mesh, 150 Å, obtained from Aldrich, Milwaukee, Wis.) and an eluant mixture of hexane and acetone in 1:4 ratio by volume. Fractions containing Compound (3) were identified and combined, and the solvents were evaporated. The yield of Compound (3) was 2.1 g (69.3%). An infrared absorption spectrum of Compound (3) was characterized by the following absorption wave numbers (KBr windows, in $cm^{-1}$): 3600-3200 (OH, broad); 3092 (aromatic CH); 2954, 2920 (aliphatic CH); 1594, 1497 (C═C); 814 (CH═CH of 1,4-disubstituted benzene), 750, 69 (CH═CH of monosubstituted benzene). A $^1$H-NMR spectrum (300 MHz) of the product in $CDCl_3$ was characterized by the following chemical shifts (δ, ppm): δ=7.50 (s, 1H, CH═N); δ=7.46-7.16 (m, 16H, Ph); δ=7.09-7.04 (m, 2H, 4-H Ph); δ=4.54-4.49 (m, 4H, ferrocene-H); δ=4.32-4.26 (m, 4H, ferrocene-H); δ=4.22-4.08 (m, 12H, ferrocene-H, CHOH); δ=δ=3.94 (dd, 2H, part of ABX system, cis-$H_A$ of $NCH_2$, $J_{AX}$=4.05 Hz, $J_{AB}$=15.0 Hz); δ=3.89 (dd, 2H, part of ABX system, trans-$H_B$ of $NCH_2$, $J_{BX}$=7.20 Hz,); δ=3.60 (m, 2H, CHOH); δ=3.16 (dd, 2H, part of ABX system, trans-$H_B$ of SCH2, $J_{AX}$=6.08 Hz, $J_{AB}$=13.8 Hz, $J_{BX}$=3.6 Hz); δ=3.11 (dd, 2H, part of ABX system, cis-$H_B$ of $SCH_2$, $J_{BX}$=6.0 Hz). An elemental analysis of the product was characterized by the following elements in weight percent: C 64.72; H 5.31; N 7.89, which compared with calculated values for $C_{52}H_{50}Fe_2N_4O_2S_3$, in weight percent of: C 64.33; H 5.15; N 5.77.

Compound (4)

Compound (1) (2.1 g, 5.829 mmole) was dissolved in 5 ml methyl ethyl ketone to yield a solution. Thioacetamide (0.205 g, 2.71 mmole, commercially obtained from Aldrich, Milwuake, Wis.) and triethylamine (0.23 g, 0.32 ml, 2.33 mmole) were added sequentially to the solution. The reaction mixture was refluxed for 2 hours. The product was purified by column chromatography using silica gel (grade 62, 60-200 mesh, 150 Å, commercially obtained from Aldrich, Milwaukee, Wis.) and an eluant mixture of hexane and acetone in 1:4 ratio by volume. Fractions containing the product were combined and the solvent was evaporated to yield 0.7 g (31.8%) of Compound (4). An infrared absorption spectrum of the product was characterized by the following absorption wave numbers (KBr windows, in $cm^{-1}$): 3600-3200 (OH, broad); 3093, 3024, 3005 (aromatic CH); 2954, 2915 (aliphatic CH); 1594, 1497 (C═C); 818 (CH═CH of 1,4-disubstituted benzene); 750, 693 (CH═CH of monosubstituted benzene). A $^1$H-NMR spectrum (300 MHz) of the product in $CDCl_3$ was characterized by the following chemical shifts (67, ppm): δ=7.52-7.48 (m, 2H, CH═N); δ=7.38-7.24 (m, 8H, Ph); 8=7.04-6.94 (m, 2H, 4-H Ph); δ=4.64-4.52 (m, 4H, ferrocene-H); δ=4.36-4.26 (m, 4H, ferrocene-H); δ=4.26-4.08 (m, 2H, CHOH); δ=4.14 (s, 10H, ferrocene-H); δ=3.96-3.74 (m, 4H, $NCH_2$); 2.98-2.84 (m, 2H, part of ABX system, cis-$H_B$ of $SCH_2$); δ=2.77 (dd, 2H, $J_{AB}$=13.9 Hz, $J_{BX}$=7.0 Hz, part of ABX system, trans-$H_A$ of $SCH_2$). An elemental analysis of the product was characterized by the following elements in weight percent: C 63.71; H 5.51; N 7.69, which compared with calculated values for $C_{40}H_{42}Fe_2N_4O_2S$, in weight percent of: C 63.67; H 5.61; N 7.43.

Compound (5)

Potassium hydroxide (1 g, 0.015 mole, 85% from Aldrich) was added to a hot solution of α,α'-dibromo-m-xylene (1,3-di(bromomethyl)benzene) (1.45 g, 5.5 mmole, from Aldrich), ferrocenecarboxaldehyde N-phenylhydrazone (3.77 g, 12.4 mmole, prepared previously) and tetrabutylammonium iodide (0.01 g, 0.027 mmole, from Aldrich) in 25 ml of butanone. After refluxed for 2 hours, the reaction mixture was diluted with ethyl acetate. The organic layer was washed with water until the washed water reached a neutral pH. The organic layer was separated, dried over anhydrous magnesium sulfate, treated with activated charcoal, and filtered. After the solvent was removed from the filtrate, the residue was purified by column chromatography using silica gel (grade 62, 60-200 mesh, 150 Å, Aldrich) and an eluant mixture of acetone and hexane in 1:7 ratio by volume. Fractions containing the product were combined and the solvents were evaporated to obtain 2.3 g (59%) of Compound (5). The crude product was recrystallized from 2-propanol. The melting point of the product was found to be 81-83° C. An infrared absorption spectrum of the product was characterized by the following absorption wave numbers (KBr windows, in $cm^{-1}$): 3091, 3058, 3024, (aromatic CH); 2954, 2954, 2924, 2855 (aliphatic CH); 1593, 1498 (C═C); 816 (CH═CH); 816 (CH═CH of 1,3-disubstituted benzene); 749, 692 (CH═CH of monosubstituted benzene). A $^1$H-NMR spectrum (300 MHz) of the product in $CDCl_3$ was characterized by the following chemical shifts (8, ppm): δ=7.40-7.14 (m, 12H, Ar); δ=6.97-6.88 (m, 2H, 4-H Ph); δ=5.10 (s, 4H, $NCH_2$); δ=4.15 (s, 4H, ferrocene-H); δ=4.28 (m, 4H, ferrocene-H); δ=4.00 (s, 10H, ferrocene-H). An elemental analysis of the product was characterized by the following elements in weight percent: C 71.21; H 5.50; N 7.92, which compared with calculated values for $C_{42}H_{38}Fe_2N_4$, in weight percent of: C 71.00; H 5.39; N 7.86.

Compound (6)

Compound (6) was prepared according to the preparation procedure described above for Compound (5) except that α,α'-dibromo-m-xylene (1,3-di(bromomethyl)benzene) was replaced by α,α'-dibromo-p-xylene (1,4-di(bromomethyl) benzene) (1.45 g, 5.5 mmole, from Aldrich). The reaction time was 3 hours. The end point of the reaction was determined by thin layer chromatography using Silufol UV-254 (from Aldrich) and an eluant mixture of ethyl acetate and hexane in a volume ratio of 1:2. After the termination of the reaction, the mixture was cooled to room temperature. The crystals formed upon cooling were filtered off and washed with hot distilled water. After the washed water reached a neutral pH, the solid was washed with 2-propanol. The crude product was recrystallized from toluene. The yield of Compound (6) was 2.5 g (64.1%). The melting point of the product was found to be 237-239° C. An infrared absorption spectrum of the product was characterized by the following absorption wave numbers (KBr windows, in $cm^{-1}$): 3080, 3062, 3006, (aromatic CH); 2957, 2869 (aliphatic CH); 1594, 1498 (C═C); 822 (CH═CH of 1,4-disubstituted benzene); 745, 691 (CH═CH of monosubstituted benzene). A $^1$H-NMR spectrum (300 MHz) of the product in $CDCl_3$ was characterized by the following chemical shifts (δ, ppm): δ=7.62-6.78 (m, 14H, Ar); δ=5.10 (s, 4H, $NCH_2$); δ=4.52 (s, 4H, ferrocene-H); δ=4.24 (m, 4H, ferrocene-H); δ=4.00 (s, 10H, ferrocene-H). An elemental analysis of the product was characterized by the following elements in weight percent: C 71.21; H 5.50; N 7.92, which compared with calculated values for $C_{42}H_{38}Fe_2N_4$, in weight percent of: C 71.00; H 5.39; N 7.86.

Compound (7)

A mixture of ferrocenecarboxaldehyde N-phenylhydrazone (15.0 g, 0.0493 mol, prepare previously) and 1,5-dibromopentane (5.67 g, 0.0246 mol, obtained from Aldrich) was dissolved in 70 ml of dimethyl sulfoxide (DMSO) in a three-necked, 250 ml round bottom flask equipped with a mechanical stirrer to form a solution. To the solution, 15 g of 50% sodium hydroxide solution was added. After the reaction mixture was heated at 80° C. for two hours with stirring, a dark liquid with a black, globular solid remained in the flask. The liquid was decanted, and the solid was dissolved in chloroform. The solution containing the solid was then washed repeatedly with water in a separatory funnel until the aqueous layers reached a neutral pH. The organic layer was isolated and dried by magnesium sulfate and purified with activated charcoal. After the magnesium sulfate and the charcoal were filtered off, the liquid was reduced in volume to 20 ml using a rotary evaporator under reduced pressure at ~40° C. Isopropyl alcohol (about 400 ml) was added to the remaining liquid until a precipitate was formed. The product was filtered off and dried to yield 6.64 g (40%) of the product. A $^1$H-NMR spectrum (300 MHz) of the product in $CDCl_3$ was characterized by the following chemical shifts (δ, ppm): 1.12-1.32 (m, 2H), 1.44-1.90 (m, 4H), 3.97-3.95 (t, 4H), 4.03-4.19 (s, 10H), 4.22-4.34 (s, 4H), 4.54-4.67 (s, 4H), 6.79-7.01 (m, 2H), 7.11-7.48 (m, 10H)

Compound (8)

A mixture of ferrocenecarboxaldehyde N-phenylhydrazone (20.0 g, 0.0657 mol, prepared previously) and diethylene glycol di(p-toluenesulfonate) (13.6 g, 0.0329 mol, obtained from Aldrich) was dissolved in 100 ml dimethyl sulfoxide (DMSO) in a 250 ml three-neck round bottom flask equipped with a mechanical stirrer to form a solution. After 20 g of 50% sodium hydroxide was added to the solution, the reaction mixture was heated at 80° C. for two hours with stirring to yield a sticky black solid and a liquid. The liquid was decanted, and the black solid was dissolved in about 100 ml of chloroform to form a solution. The chloroform solution was washed repeatedly with water in a separatory funnel until the aqueous layers reached a neutral pH. After the organic layer was isolated and dried with magnesium sulfate and filtered, the dry organic layer was treated with activated charcoal and filtered. The filtrate was purified by filtering through silica gel 3 times until thin layer chromatography indicated a pure product by showing only one spot. The solvent was removed from the filtrate with a rotary evaporator under reduced pressure and at low heat to yield a thin, sticky, reddish residue. The residue was recrystallized from a mixture of tetrahydrofuran and isopropyl alcohol. The yield of the product was 8.2 g (37%). A $^1$H-NMR spectrum (300 MHz) of the product in $CDCl_3$ was characterized by the following chemical shifts (δ, ppm): 3.68-3.81 (t, 4H), 3.99-4.05 (t, 4H), 4.05-4.18 (s, 10H), 4.23-4.34 (s, 4H), 4.53-4.64 (s, 4H), 6.86-6.97 (m, 2H), 7.22-7.39 (m, 8H), 7.41-7.48 (s, 2H)

Compound (9)

A mixture of ferrocenecarboxaldehyde N-phenylhydrazone (14.73 g, 0.0484 mol, prepared previously) and 1,10-dibromodecane (7.26 g, 0.0242 mol, obtained from Aldrich) was dissolved in 70 ml of dimethyl sulfoxide (DMSO) in a 250 ml three-necked round bottom flask equipped with a mechanical stirrer to form a solution. After 15 g of 50% sodium hydroxide solution was added to the solution, the reaction mixture was heated at 80° C. for two hours with stirring to yield a dark liquid and a black, globular solid. The liquid was decanted away, and the solid was dissolved in chloroform. The chloroform solution was washed repeatedly with water in a separatory funnel until the aqueous layers reached a neutral pH. The organic layer was isolated and (i) dried with magnesium sulfate, (ii) treated with activated charcoal, and (iii) filtered. The filtrate was (iv) filtered through silica gel. These purification steps (i-iv) were repeated until thin layer chromatography indicated a pure product by showing only one spot. The organic solvent was removed in a rotary evaporator under reduced pressure and at low heat until a sticky residue resulted. After the residue was dissolved in tetrahydrofuran to form a solution, isopropyl alcohol was added to the solution until a solid material began to precipitate out. After the solution was left in a refrigerator overnight, a powdery and light colored solid was formed. The yield of the product was 6.33 g (35%). A $^1$H-NMR spectrum (300 MHz) of the product in $CDCl_3$ was characterized by the following chemical shifts (δ, ppm): 0.84-0.94 (m, 4H), 1.15-1.78 (m, 12H), 3.72-3.89 (t, 4H), 4.07-4.22 (s, 10H), 4.22-4.37 (s, 4H), 4.54-4.68 (s, 4H), 6.79-6.96 (m, 2H), 7.17-7.41 (m, 10H)

Compound (10)

Compound (10) may be prepared similarly according to the procedure for Compound (7) except that 1,5-dibromopentane is replaced by triethylenglycol di-tosylate Compound (11)

Compound (11) may be prepared similarly according to the procedure for Compound (7) except that 1,5-dibromopentane is replaced by 1,8-dibromooctane Compound (12)

Compound (12) may be prepared similarly according to the procedure for Compound (7) except that 1,5-dibromopentane is replaced by 1,12-dibromododecane Compound (13)

Compound (13) may be prepared similarly according to the procedure for Compound (7) except that ferrocenecarboxaldehyde N-phenylhydrazone is replaced by 1,1'-ferrocenedicarboxaldehyde bis(N-phenylhydrazone) and the molar ratio between 1,1'-ferrocenedicarboxaldehyde bis(N-phenylhydrazone) and 1,5-dibromopentane is 1:1. 1,1'-Ferrocenedicarboxaldehyde bis(N-phenylhydrazone) may be prepared similarly according to the procedure for ferrocenecarboxaldehyde N-phenylhydrazone except that ferrocenecarboxaldehyde is replaced with 1,1'-ferrocenedicarboxaldehyde (available from Aldrich) and the molar ratio of 1,1'-ferrocenedicarboxaldehyde to N-phenyl hydrazine is 1:2. The polymeric side product may be removed by conventional purification techniques such as extraction, recrystallization, and chromatography.

Compound (14)

Compound (14) may be prepared similarly according to the procedure for Compound (13) except that 1,5-dibromopentane is replaced by diethylene glycol di(p-toluenesulfonate) (available from Aldrich). The polymeric side product may be removed by conventional purification techniques such as extraction, recrystallization, and chromatography.

Compound (15)

Compound (15) may be prepared similarly according to the procedure for Compound (13) except that 1,5-dibromopentane is replaced by 1,10-dibromodecane. Compound (15) may be separated from the polymeric side product, Compound (20), by conventional purification techniques such as extraction, recrystallization, and chromatography.

Compound (16)

Compound (16) may be prepared similarly according to the procedure for Compound (13) except that 1,5-dibromopentane is replaced by triethylene glycol di(p-toluenesulfonate) (available from Aldrich). The polymeric side product may be removed by conventional purification techniques such as extraction, recrystallization, and chromatography.

Compound (17)

A mixture of ferrocenecarboxaldehyde (10 g, 0.0467 mole, commercially available from Aldrich) and {4-[4-hydrazinophenyl)sulfonyl]phenyl}hydrazine (6.18 g, 0.0222 mole, prepared as described in the article by D. Tokunaga, T. Hattor, and T. Kubi., *Chem. Abstr.*, (1957) 52, 112911) was dissolved in 110 ml of dioxane. After stirred at 60° C. for 2 hours, the reaction mixture was cooled to room temperature. The crystals formed upon cooling were filtered and washed with 2-propanol to yield 10.7 g (71.9%) of a dihydrazone intermediate. The dihydrazone intermediate was used as it was in the next step. An infrared absorption spectrum of the dihydrazone intermediate was characterized by the following absorption wave numbers (KBr windows, in $cm^{-1}$): 3257 (NH); 3099, 3033, 3000, 2954, 2886, 2854 1593 (C═C of cyclic alkenes). A $^1$H-NMR spectrum (300 MHz) of the dihydrazone intermediate in DMSO-$d_6$ was characterized by the following chemical shifts (δ, ppm): δ=10.56 (s, 2H, NH); δ=7.76 (s, 2H, CH═N); δ=7.66 (d, J=9 Hz, 4H, 3-H, 5-H Ar); 8=7.03 (d, J=9 Hz, 4H, 2-H, 6-H Ar); δ=4.60 (m, 4H, ferrocene-H); δ=4.35 (s, 4H, ferrocene-H); δ=4.16 (s, 10H, ferrocene-H). An elemental analysis of the dihydrazone intermediate was characterized by the following elements in weight percent: C 60.89; H 4.61; N 8.64, which compared with calculated values for $C_{34}H_{30}Fe_2N_4SO_2$, in weight percent of: C 60.92; H 4.51; N 8.36.

A mixture of the dihydrazone intermediate (3.94 g, 5.88 mmole, prepared above) and epichlorohydrin (12.03 g, 10.3 ml, 0.13 mole) was added to a 100 ml 3-neck round bottom flask. The reaction mixture was stirred vigorously at 35-40° C. for 3 hours, during which powdered 85% potassium hydroxide (1.72 g, 0.026 mol) and anhydrous sodium sulfate (0.5 g, 0.0035 mol) were added in three portions while the reaction mixture was kept at 20-25° C. After the termination of the reaction, the reaction mixture was cooled to room temperature and filtered. The organic phase was separated, treated with ethyl acetate, and washed with distilled water until the washed water reached a neutral pH. The organic layer was isolated, dried over anhydrous magnesium sulfate, treated with activated charcoal, and filtered. The solvents were removed to obtain a residue. The residue was purified by column chromatography using silica gel (grade 62, 60-200 mesh, 150 Å, Aldrich) and an eluent mixture of acetone and hexane in a volume ratio of 3:22. Fractions containing Compound (17) were combined and the solvents were evaporated to a solid. The solid was recrystallized from a mixture of acetone and hexane in a volume ratio of 3:22 and dried at 50° C. in a vacuum oven for 4 hours. The yield of Compound (17) was 2.08 g (45%). The melting point of the product was found to be 145-147° C. An infrared absorption spectrum of the product was characterized by the following absorption wave numbers (KBr windows, in $cm^{-1}$): 3084, 2995 (CH of cyclic alkenes and aromatic CH); 2954, 2925, 2854 (aliphatic CH); 1588, 1498 (C═C, C—N). A $^1$H-NMR spectrum (300 MHz) of the product in DMSO-$d_6$ was characterized by the following chemical shifts (δ, ppm): δ=7.81 (d, J=9.1 Hz, 4H, 3-H, 5-H Ar); δ=7.63 (s, 2H, CH═N); δ=7.34 (d, J=9.1 Hz, 4H, 2-H, 6-H Ar); δ=4.64-4.60 (m, 4H, ferrocene-H); δ=4.40-4.32 (m, 6H, ferrocene-H, 2H of 2NCH2); δ=4.15 (s, 10H, ferrocene-H); δ=3.93-3.83 (m, 2H, NCH2); δ=3.30-3.20 (m, 2H, CH of epoxy group); δ=2.85 and 2.57 (two m, 4H, CHCH2). An elemental analysis of the dihydrazone intermediate was characterized by the following elements in weight percent: C 61.43; H 5.26; N 7.35, which compared with calculated values for $C_{40}H_{38}Fe_2N_4SO_4$, in weight percent of: C 61.24; H 5.14; N 7.14.

Compound (18)

Compound (17) (0.75 g, 0.96 mmole), 4,4'-thiobisbenzenethiol (0.24 g, 0.96 mmole, obtained from Aldrich chemicals), and triethylamine (0.097 g, 0.13 ml, 0.96 mmole, from Aldrich, Milwaukee, Wis.) were dissolved sequentially in 15 ml of tetrahydrofuran. After refluxed under argon for 60 hours, the reaction mixture was cooled to room temperature and then poured with intensive stirring into a 20-fold excess of methanol. The resulting precipitate was filtered off and dried under vacuum at 50° C. The yield of Compound (18) was 0.85 g (86%). An infrared absorption spectrum of the product was characterized by the following absorption wave numbers (KBr windows, in $cm^{-1}$): 3473 (OH, broad); 3091 (aromatic CH); 2915 (aliphatic CH); 1587, 1497, 1475 (C═C, C—N, C═N); 818 (CH═CH of 1,4-disubstituted benzenes).

Compound (19)

Compound (19) may be prepared similarly according to the procedure for compound (18) except that Compound (17) is replaced with Compound (2).

Compound (20)

Compound (20) may be prepared similarly according to the procedure for Compound (15) except that the reaction time is changed from 2 hours to 24 hours. Compound (20) may be separated from the cyclic side products, such as Compound (15), by conventional purification techniques such as extraction, recrystallization, and chromatography.

Compound (21)

Compound (21) may be prepared similarly by the procedure for Compound (1) except that ferrocenecarboxaldehyde is replaced with benzoylferrocene (available from Aldrich, Milwaukee, Wis.).

Compound (22)

Compound (22) may be prepared similarly by the procedure for Compound (2) except that 1,1'-ferrocenedicarboxaldehyde is replaced with 1,1'-diacetylferrocene (available from Aldrich, Milwaukee, Wis.).

Compound (23)

Compound (23) may be prepared by reacting 1,1'-ferrocenedicarboxaldehyde (available from Aldrich, Milwaukee, Wis.) with hydrazine (available from Aldrich, Milwaukee, Wis.) in a molar ratio of 1:1 at an elevated temperature in a solvent such as tetrahydrofuran and ketones for ~6 hours. The product may be isolated and purified by conventional purification techniques such as extraction, recrystallization, and chromatography.

Compound (24)

Compound (24) may be prepared by reacting ferrocenecarboxaldehyde (available form Aldrich, Milwaukee, Wis.) with hydrazine (available from Aldrich, Milwaukee, Wis.) in a molar ratio of 2:1 at an elevated temperature in a solvent such as tetrahydrofuran and ketones for ~6 hours. The product may be isolated and purified by conventional purification techniques such as extraction, recrystallization, and chromatography.

Compound (25)

Compound (25) may be prepared by reacting ferrocenecarboxaldehyde (available form Aldrich, Milwaukee, Wis.)

with 4,4'-diaminostilbene dihydrochloride (available from Aldrich, Milwaukee, Wis.) in a molar ratio of 2:1 at an elevated temperature in a solvent such as tetrahydrofuran and ketones for ~6 hours. Potassium carbonate may be added to the reaction mixture to neutralize the hydrochloride in 4,4'-diaminostilbene dihydrochloride. The product may be isolated and purified by conventional purification techniques such as extraction, recrystallization, and chromatography.

Compound (26)

Compound (26) may be prepared by reacting ferrocenecarboxaldehyde (available form Aldrich, Milwaukee, Wis.) with 1,4-benzenediamine (available from Aldrich, Milwaukee, Wis.) in a molar ratio of 2:1 at an elevated temperature in a solvent such as tetrahydrofuran and ketones for ~6 hours. The product may be isolated and purified by conventional purification techniques such as extraction, recrystallization, and chromatography.

Compound (27)

Compound (27) may be prepared by reacting 1,1'-ferrocenedicarboxaldehyde (available form Aldrich, Milwaukee, Wis.) with hydrazine (available from Aldrich, Milwaukee, Wis.) in a molar ratio of 1:1 at an elevated temperature in a solvent such as tetrahydrofuran and ketones for ~24 hours. The product may be isolated and purified by conventional purification techniques such as extraction, recrystallization, and chromatography.

Compound (28)

Compound (28) may be prepared by reacting 1,1'-ferrocenedicarboxaldehyde (available form Aldrich, Milwaukee, Wis.) with 1,4-benzenediamine (available from Aldrich, Milwaukee, Wis.) in a molar ratio of 1:1 at an elevated temperature in a solvent such as tetrahydrofuran and ketones for ~24 hours. The product may be isolated and purified by conventional purification techniques such as extraction, recrystallization, and chromatography.

Compound (29)

Compound (24) may be prepared by reacting ferrocenecarboxaldehyde (available form Aldrich, Milwaukee, Wis.) with N,N,N',N'-tetrakis(4-aminophenyl)benzidine (available from Aldrich, Milwaukee, Wis.) in a molar ratio of 4:1 at an elevated temperature in a solvent such as tetrahydrofuran and ketones for 6 hours. The product may be isolated and purified by conventional purification techniques such as extraction, recrystallization, and chromatography.

Example 2

Charge Mobility Measurements

This example describes the measurement of charge mobility and ionization potential for charge transport materials, specifically Compounds (3)-(8), (17), and (18).

Sample 1

A mixture of 0.1 g of Compound (3) and 0.1 g of polycarbonate Z (obtained from Mitsubishi Engineering Plastics Corp., White Plain, N.Y.) was dissolved in 2 ml of tetrahydrofuran (THF). The solution was coated on a polyester film with a conductive aluminum layer by a trough coating (or "dip roller") method (where the substrate was affixed to a roller that rotated through a trough containing the coating solution). After the coating was dried for 1 hour at 80° C., a clear 10 μm thick layer was formed. The hole mobility of the sample was measured and the results are presented in Table 1.

Sample 2

A mixture of 0.1 g of Compound (4) and 0.1 g of polycarbonate Z was dissolved in 2 ml of tetrahydrofuran (THF). The solution was coated on a polyester film with a conductive aluminum layer by a trough coating (or "dip roller") method (where the substrate was affixed to a roller that rotated through a trough containing the coating solution). After the coating was dried for 1 hour at 80° C., a clear 10 μm thick layer was formed. The hole mobility of the sample was measured and the results are presented in Table 1.

Sample 3

A mixture of 0.1 g of Compound (5) and 0.1 g of polycarbonate Z was dissolved in 2 ml of tetrahydrofuran (THF). The solution was coated on a polyester film with a conductive aluminum layer by a trough coating (or "dip roller") method (where the substrate was affixed to a roller that rotated through a trough containing the coating solution). After the coating was dried for 1 hour at 80° C., a clear 10 μm thick layer was formed. The hole mobility of the sample was measured and the results are presented in Table 1.

Sample 4

A mixture of 0.1 g of Compound (6) and 0.1 g of polycarbonate Z was dissolved in 2 ml of tetrahydrofuran (THF). The solution was coated on a polyester film with a conductive aluminum layer by a trough coating (or "dip roller") method (where the substrate was affixed to a roller that rotated through a trough containing the coating solution). After the coating was dried for 1 hour at 80° C., a clear 10 μm thick layer was formed. The hole mobility of the sample was measured and the results are presented in Table 1.

Sample 5

A mixture of 0.1 g of Compound (7) and 0.1 g of polycarbonate Z was dissolved in 2 ml of tetrahydrofuran (THF). The solution was coated on a polyester film with a conductive aluminum layer by a trough coating (or "dip roller") method (where the substrate was affixed to a roller that rotated through a trough containing the coating solution). After the coating was dried for 1 hour at 80° C., a clear 10 μm thick layer was formed. The hole mobility of the sample was measured and the results are presented in Table 1.

Sample 6

A mixture of 0.1 g of Compound (8) and 0.1 g of polycarbonate Z was dissolved in 2 ml of tetrahydrofuran (THF). The solution was coated on a polyester film with a conductive aluminum layer by a trough coating (or "dip roller") method (where the substrate was affixed to a roller that rotated through a trough containing the coating solution). After the coating was dried for 1 hour at 80° C., a clear 10 μm thick layer was formed. The hole mobility of the sample was measured and the results are presented in Table 1.

Sample 7

A mixture of 0.1 g of Compound (17) and 0.1 g of polycarbonate Z was dissolved in 2 ml of tetrahydrofuran (THF). The solution was coated on a polyester film with a conductive aluminum layer by a trough coating (or "dip roller") method (where the substrate was affixed to a roller that rotated through a trough containing the coating solution). After the coating was dried for 1 hour at 80° C., a clear 10 μm thick layer was formed. The hole mobility of the sample was measured and the results are presented in Table 1.

Sample 8

A mixture of 0.1 g of Compound (18) and 0.1 g of polycarbonate Z was dissolved in 2 ml of tetrahydrofuran (THF). The solution was coated on a polyester film with a conductive aluminum layer by a trough coating (or "dip roller") method (where the substrate was affixed to a roller that rotated through a trough containing the coating solution). After the coating was dried for 1 hour at 80° C., a clear 10 μm thick layer was formed. The hole mobility of the sample was measured and the results are presented in Table 1.

Mobility Measurements

Each sample was corona charged positively up to a surface potential U and illuminated with 2 ns long nitrogen laser light pulse. The hole mobility μ was determined as described in Kalade et al., "Investigation of charge carrier transfer in electrophotographic layers of chalkogenide glasses," Proceeding IPCS 1994: The Physics and Chemistry of Imaging Systems, Rochester, N.Y., pp. 747-752, incorporated herein by reference. The hole mobility measurement was repeated with appropriate changes to the charging regime to charge the sample to different U values, which corresponded to different electric field strength inside the layer E. This dependence on electric field strength was approximated by the formula $$\mu=\mu_0 e^{\alpha\sqrt{E}}.$$

Here E is electric field strength, $\mu_0$ is the zero field mobility and α is Pool-Frenkel parameter. Table 1 lists the mobility characterizing parameters $\mu_0$ and α values and the mobility value at the $6.4\times10^5$ V/cm field strength as determined by these measurements for the samples.

TABLE 1

| Sample | $\mu_0$ ($cm^2/V \cdot s$) | μ ($cm^2/V \cdot s$) at $6.4 \cdot 10^5$ V/cm | α $(cm/V)^{0.5}$ | Ionization Potential (eV) |
|---|---|---|---|---|
| Sample 1 | ~$6.0 \times 10^{-10}$ | ~$1.0 \times 10^{-8}$ | ~0.004 | / |
| Compound (3) | / | / | / | 5.35 |
| Sample 2 | ~$1.0 \times 10^{-9}$ | $2.0 \times 10^{-8}$ | ~0.0038 | / |
| Compound (4) | / | / | / | 5.38 |
| Sample 3 | $6.0 \times 10^{-9}$ | $5.7 \times 10^{-8}$ | 0.0028 | / |
| Compound (5) | / | / | / | 5.37 |
| Sample 4 | $5.5 \times 10^{-9}$ | $4.0 \times 10^{-7}$ | 0.0056 | / |
| Compound (6) | / | / | / | 5.35 |
| Sample 5 | ~$3.4 \times 10^{-9}$ | $3.0 \times 10^{-8}$ | ~0.0037 | / |
| Compound (7) | / | / | / | 5.43 |
| Sample 6 | ~$1.8 \times 10^{-9}$ | ~$1.2 \times 10^{-8}$ | ~0.0023 | / |
| Compound (8) | / | / | / | 5.42 |
| Sample 7 | $1.5 \times 10^{-10}$ | $1.4 \times 10^{-8}$ | 0.0057 | / |
| Compound (17) | / | / | / | 5.40 |
| Sample 8 | $7.5 \times 10^{-10}$ | $7.8 \times 10^{-8}$ | 0.0058 | / |
| Compound (18) | / | / | / | 5.41 |

Example 3

Ionization Potential Measurements

This example describes the measurement of the ionization potential for the charge transport materials described in Example 1.

To perform the ionization potential measurements, a thin layer of a charge transport material about 0.5 μm thickness was coated from a solution of 2 mg of the charge transport material in 0.2 ml of tetrahydrofuran on a 20 $cm^2$ substrate surface. The substrate was an aluminized polyester film coated with a 0.4 μm thick methylcellulose sub-layer.

Ionization potential was measured as described in Grigalevicius et al., "3,6-Di(N-diphenylamino)-9-phenylcarbazole and its methyl-substituted derivative as novel hole-transporting amorphous molecular materials," Synthetic Metals 128 (2002), p. 127-131, incorporated herein by reference. In particular, each sample was illuminated with monochromatic light from the quartz monochromator with a deuterium lamp source. The power of the incident light beam was $2\text{-}5\cdot10^{-8}$ W. A negative voltage of −300 V was supplied to the sample substrate. A counter-electrode with the 4.5×15 $mm^2$ slit for illumination was placed at 8 mm distance from the sample surface. The counter-electrode was connected to the input of a BK2-16 type electrometer, working in the open input regime, for the photocurrent measurement. A $10^{-15}$-$10^{-12}$ amp photocurrent was flowing in the circuit under illumination. The photocurrent, I, was strongly dependent on the incident light photon energy hv. The $I^{0.5}=f(hv)$ dependence was plotted. Usually, the dependence of the square root of photocurrent on incident light quanta energy is well described by linear relationship near the threshold (see references "Ionization Potential of Organic Pigment Film by Atmospheric Photoelectron Emission Analysis," *Electrophotography*, 28, Nr. 4, p. 364 (1989) by E. Miyamoto, Y. Yamaguchi, and M. Yokoyama; and "Photoemission in Solids," Topics in Applied Physics, 26, 1-103 (1978) by M. Cordona and L. Ley, both of which are incorporated herein by reference). The linear part of this dependence was extrapolated to the hv axis, and the Ip value was determined as the photon energy at the interception point. The ionization potential measurement has an error of ±0.03 eV. The ionization potential values are given in Table 1 above.

As understood by those skilled in the art, additional substitution, variation among substituents, and alternative methods of synthesis and use may be practiced within the scope and intent of the present disclosure of the invention. The embodiments above are intended to be illustrative and not limiting. Additional embodiments are within the claims. Although the present invention has been described with reference to particular embodiments, workers skilled in the art will recognize that changes may be made in form and detail without departing from the spirit and scope of the invention.

What is claimed is:

1. An organophotoreceptor comprising an electrically conductive substrate and a photoconductive element on the electrically conductive substrate, the photoconductive element comprising:

(a) a charge transport material having the formula:

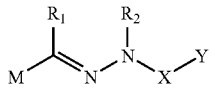

where M comprises a metallocenyl group;

Y comprises a functional group selected from the group consisting of a metallocenyl group, a hydrazone group, an azine group, a reactive ring group, an ethylenically unsaturated group, and combinations thereof;

$R_1$ and $R_2$ comprise, each independently, H, an organic group, or an organometallic group; and X is a bond, O, S, an aminylene group, a sulfonyl group, an organic linking group, or a combination thereof; and (b) a charge generating compound.

2. The organophotoreceptor of claim 1 wherein the photoconductive element further comprises a second charge transport material.

3. The organophotoreceptor of claim 2 wherein the second charge transport material comprises an electron transport compound.

4. The organophotoreceptor of claim 1 wherein the photoconductive element further comprises a binder.

5. The organophotoreceptor of claim 1 wherein Y comprises at least an acyl-metallocene hydrazone group having the formula:

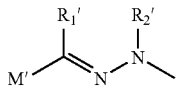

where M' comprises a metallocenyl group; and $R_1'$ and $R_2'$ comprise, each independently, H, an organic group, or an organometallic group.

6. The organophotoreceptor 5 wherein one hydrogen in M and one hydrogen in M' together are substituted with a divalent organic group to form a cyclic compound.

7. The organophotoreceptor of claim 1 wherein M comprises at least a substituent having the formula:

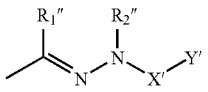

where Y' comprises a functional group selected from the group consisting of a metallocenyl group, a hydrazone group, an azine group, a reactive ring group, an ethylenically unsaturated group, and combinations thereof; $R_1''$ and $R_2''$ comprise, each independently, H, an organic group, or an organometallic group; and X' is a bond O, S, an aminylene group, a sulfonyl group, an organic linking group, or a combination thereof.

8. The organophotoreceptor of claim 5 wherein X comprises the formula:

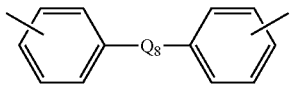

where $Q_8$ is a bond, O, S, an alkylene, an arylene group, a carbonyl group, a sulfonyl group, or $NR_4$, and $R_4$ is H or an organic group.

9. An organophotoreceptor comprising an electrically conductive substrate and a photoconductive element on the electrically conductive substrate, the photoconductive element comprising:

(a) a charge transport material comprising the formula:

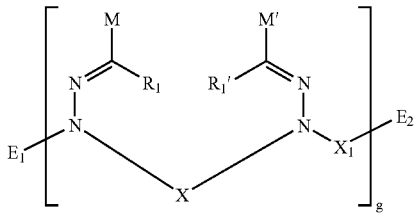

where M and M' comprise, each independently, a metallocenyl group; X and $X_1$ are, each independently, O, S, an aminylene group, a sulfonyl group, an organic linking group, or a combination thereof; $R_1$ and $R_1'$ comprise, each independently, H, an organic group, or an organometallic group; g is an average of a distribution of integers between 1 and 5,000; and $E_1$ and $E_2$ are each a terminal group; and (b) a charge generating compound.

10. An organophotoreceptor comprising an electrically conductive substrate and a photoconductive element on the electrically conductive substrate, the photoconductive element comprising:

(a) a charge transport material comprising the formula:

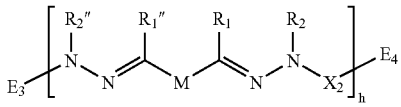

where $R_1$, $R_2$, $R_1''$, and $R_2''$ comprise, each independently, H, an organic group, or an organometallic group; $X_2$ is O, S, an aminylene group, a sulfonyl group, an organic linking group, or a combination thereof; M comprises a metallocenyl group; h is an average of a distribution of integers between 1 and 5,000; and $E_3$ and $E_4$ are each a terminal group; and (b) a charge generating compound.

11. An electrophotographic imaging apparatus comprising:

(a) a light imaging component; and (b) an organophotoreceptor oriented to receive light from the light imaging component, the organophotoreceptor comprising an electrically conductive substrate and a photoconductive element on the electrically conductive substrate, the photoconductive element comprising:

(i) a charge transport material having the formula

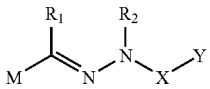

where M comprises a metallocenyl group; Y comprises a functional group selected from the group consisting of a metallocenyl group, a hydrazone group, an azine group, a reactive ring group, an ethylenically unsaturated group, and combinations thereof; $R_1$ and $R_2$ comprise, each independently, H, an organic group, or an organometallic group; and X is a bond, O, S, an aminylene group, a sulfonyl group, an organic linking group, or a combination thereof; and (ii) a charge generating compound.

12. The electrophotographic imaging apparatus of claim 11 further comprising a toner dispenser.

13. An electrophotographic imaging apparatus comprising:

(a) a light imaging component; and (b) an organophotoreceptor oriented to receive light from the light imaging component, the organophotoreceptor comprising an electrically conductive substrate and a photoconductive element on the electrically conductive substrate, the photoconductive element comprising:

(i) a charge transport material comprising the formula:

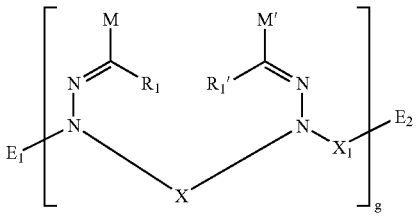

where M and M' comprise, each independently, a metallocenyl group; X and $X_1$ are, each independently, O, S, an aminylene group, a sulfonyl group, an organic linking group, or a combination thereof; $R_1$ and $R_1$' comprise, each independently, H, an organic group, or an organometallic group; g is an average of a distribution of integers between 1 and 5,000; and $E_1$ and $E_2$ are each a terminal group; and (ii) a charge generating compound.

14. An electrophotographic imaging apparatus comprising:

(a) a light imaging component; and (b) an organophotoreceptor oriented to receive light from the light imaging component, the organophotoreceptor comprising an electrically conductive substrate and a photoconductive element on the electrically conductive substrate, the photoconductive element comprising:

(i) a charge transport material comprising the formula:

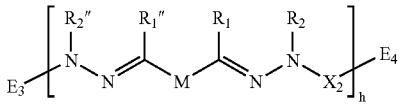

where $R_1$, $R_2$, $R_1$", and $R_2$" comprise, each independently, H, an organic group, or an organometallic group; $X_2$ is O, S, an aminylene group, a sulfonyl group, an organic linking group, or a combination thereof; M comprises a metallocenyl group; h is an average of a distribution of integers between 1 and 5,000; and $E_3$ and $E_4$ are each a terminal group; and (ii) a charge generating compound.

15. An electrophotographic imaging process comprising;

(a) applying an electrical charge to a surface of an organophotoreceptor comprising an electrically conductive substrate and a photoconductive element on the electrically conductive substrate, the photoconductive element comprising (i) a charge transport material comprising the formula:

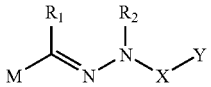

where M comprises a metallocenyl group; Y comprises a functional group selected from the group consisting of a metallocenyl group, a hydrazone group, an azine group, a reactive ring group, an ethylenically unsaturated group, and combinations thereof; $R_1$ and $R_2$ comprise, each independently, H, an organic group, or an organometallic group; and X is a bond, O, S, an aminylene group, a sulfonyl group, an organic linking group, or a combination thereof; and (ii) a charge generating compound.

(b) imagewise exposing the surface of the organophotoreceptor to radiation to dissipate charge in selected areas and thereby form a pattern of charged and uncharged areas on the surface;

(c) contacting the surface with a toner to create a toned image; and (d) transferring the toned image to substrate.

16. The electrophotographic imaging process of claim 15 wherein the toner comprising colorant particles.

17. An electrophotographic imaging process comprising;

(a) applying an electrical charge to a surface of an organophotoreceptor comprising an electrically conductive substrate and a photoconductive element on the electrically conductive substrate, the photoconductive element comprising (i) a charge transport material comprising the formula:

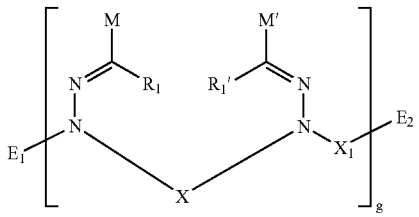

where M and M' comprise, each independently, a metallocenyl group; X and $X_1$ are, each independently, O, S, an aminylene group, a sulfonyl group, an organic linking group, or a combination thereof; $R_1$ and $R_1$' comprise, each independently, H, an organic group, or an organometallic group; g is an average of a distribution of integers between 1 and 5,000; and $E_1$ and $E_2$ are each a terminal group; and (ii) a charge generating compound (b) imagewise exposing the surface of the organophotoreceptor to radiation to dissipate charge in selected areas and thereby form a pattern of charged and uncharged areas on the surface;

(c) contacting the surface with a toner to create a toned image; and (d) transferring the toned image to substrate.

18. An electrophotographic imaging process comprising;

(a) applying an electrical charge to a surface of an organophotoreceptor comprising an electrically conductive substrate and a photoconductive element on the electrically conductive substrate, the photoconductive element comprising (i) a charge transport material comprising the formula:

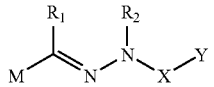

where $R_1$, $R_2$, $R_1$", and $R_2$"comprise, each independently, H, an organic group, or an organometallic group; $X_2$ is O, S, an aminylene group, a sulfonyl group, an organic linking group, or a combination thereof; M comprises a metallocenyl group; h is an average of a distribution of integers between 1 and 5,000; and $E_3$ and $E_4$ are each a terminal group; and (ii) a charge generating compound, (b) imagewise exposing the surface of the organophotoreceptor to radiation to dissipate charge in selected areas and thereby form a pattern of charged and uncharged areas on the surface;

(c) contacting the surface with a toner to create a toned image; and (d) transferring the toned image to substrate.

* * * * *